US009021798B2

(12) United States Patent
Sipola et al.

(10) Patent No.: US 9,021,798 B2
(45) Date of Patent: May 5, 2015

(54) DIGITAL HYDRAULIC SYSTEM

(75) Inventors: Ari Sipola, Kangasala (FI); Hannu-Pekka S Vihtanen, Tampere (FI); Matti O Linjama, Valkkien (FI); Arto T. T. Laamanen, Lempaala (FI)

(73) Assignee: Norrhydro Oy, Rovaniemi (FI)

( * ) Notice: Subject to any disclaimer, the term of this patent is extended or adjusted under 35 U.S.C. 154(b) by 995 days.

(21) Appl. No.: 13/122,823

(22) PCT Filed: Apr. 2, 2009

(86) PCT No.: PCT/FI2009/050252

§ 371 (c)(1),
(2), (4) Date: Jul. 1, 2011

(87) PCT Pub. No.: WO2010/040890

PCT Pub. Date: Apr. 15, 2010

(65) Prior Publication Data

US 2011/0259187 A1 Oct. 27, 2011

(30) Foreign Application Priority Data

Oct. 10, 2008 (FI) ..... 20085958

(51) Int. Cl.
*F15B 11/036* (2006.01)
*F15B 21/14* (2006.01)

(52) U.S. Cl.
CPC ..... *F15B 11/036* (2013.01); *F15B 2211/20592* (2013.01); *F15B 2211/212* (2013.01);
(Continued)

(58) Field of Classification Search
CPC .. F15B 11/036; F15B 21/14; F15B 2211/327; F15B 2211/30575; F15B 2211/212; F15B 2211/20592; F15B 2211/76; F15B 2211/7055
USPC ..... 60/413, 416, 428
See application file for complete search history.

(56) References Cited

U.S. PATENT DOCUMENTS 5,011,180 A 4/1991 Dunwoody
2001/0032542 A1 10/2001 Heikkila
(Continued)

FOREIGN PATENT DOCUMENTS

CN 1965168 A 5/2007
DE 38 36 371 A1 5/1990
(Continued)

OTHER PUBLICATIONS

Office Action issued in Chinese Patent Application No. 200980149893.3 dated Jul. 31, 2013.
(Continued)

*Primary Examiner* — Thomas E Lazo
(74) *Attorney, Agent, or Firm* — Oliff PLC

(57) ABSTRACT

A method and a pressurized medium system, including: at least one actuator to generate sum forces effective on a load; a working chamber operating by displacement and located in the actuator; a charging circuit of a higher pressure, which is a source of hydraulic power; a charging circuit of a lower pressure, which is a source of hydraulic power; a control circuit, that couples the charging circuit of higher pressure and the charging circuit of lower pressure, in turn, to the working chamber; wherein the working chamber is capable of generating force components that correspond to the pressure of the charging circuit to be coupled to the working chamber, and each force component produces at least one of the sum forces either alone or in combination with the force components produced by the other working chambers of the actuator.

44 Claims, 14 Drawing Sheets

(52) U.S. Cl.
CPC . *F15B2211/30575* (2013.01); *F15B 2211/327* (2013.01); *F15B 2211/7055* (2013.01); *F15B 2211/76* (2013.01); *F15B 21/14* (2013.01)

(56) References Cited

U.S. PATENT DOCUMENTS

| | | | | |
|---|---|---|---|---|
| 2003/0041598 | A1 | 3/2003 | Takeuchi et al. | |
| 2005/0194225 | A1 | 9/2005 | Antonovsky | |
| 2007/0120662 | A1 * | 5/2007 | Bishop | 340/500 |

FOREIGN PATENT DOCUMENTS

| | | | |
|---|---|---|---|
| DE | 102004027849 | A1 * | 1/2006 |
| DE | 10 2005 014 866 | A1 | 10/2006 |
| JP | 55-163504 | | 11/1980 |
| JP | A 57-174541 | | 10/1982 |
| JP | 61-044002 | | 3/1986 |
| JP | 4-011798 | | 1/1992 |
| JP | 2001-289203 | | 10/2001 |
| JP | A 2002-066799 | | 3/2002 |
| JP | 2007/0247727 | | 9/2007 |
| SU | 1019118 | A | 5/1983 |
| SU | 1701995 | A1 | 12/1991 |
| SU | 1740802 | A1 | 6/1992 |
| WO | WO 2005/121564 | A1 | 12/2005 |

OTHER PUBLICATIONS

Extended Search Report issued in European Patent Application No. 12187900.1 dated Jun. 7, 2013.
Extended Search Report issued in European Patent Application No. 09818842.8 dated Jul. 11, 2013.
Office Action issued in FI 20085958, dated Jun. 9, 2009. (with English-language translation).
Search Report issued in FI 20085958, dated Jun. 8, 2009. (with English-language translation).
International Search Report issued in PCT/FI2009/050252, mailed Aug. 24, 2009.
Written Opinion issued in PCT/FI2009/050252, mailed Aug. 24, 2009.
International Preliminary Report on Patentability issued in PCT/FI2009/050252, dated Feb. 9, 2011.
Office Action issued in Russian Application No. 2011118361 dated Dec. 11, 2012.
Jul. 7, 2014 Office Action issued in Japanese Application No. 2011-530514.

* cited by examiner $\overline{F_cyl}=\overline{FA}+\overline{FB}+\overline{FC}+\overline{FD}$ $\overline{F_tot}=\overline{F_cyl}+\overline{F_load}$

| Cntrl | HP/LP dec/bin | | | | | a/HP | a/LP | dec/bin | | | | | | | | |
|---|---|---|---|---|---|---|---|---|---|---|---|---|---|---|---|---|
| u% | dec 0...15 | A | B | C | D | | | dec 0...255 | A-T | P-A | B-T | P-B | C-T | P-C | D-T | P-D |
| 0 | 5 | 0 | 1 | 0 | 1 | -5 | 10 | 153 | 1 | 0 | 0 | 1 | 1 | 0 | 0 | 1 |
| 1 | 4 | 0 | 1 | 0 | 0 | -4 | 9 | 154 | 1 | 0 | 0 | 1 | 1 | 0 | 1 | 0 |
| 2 | 7 | 0 | 1 | 1 | 1 | -3 | 8 | 149 | 1 | 0 | 0 | 1 | 0 | 1 | 0 | 1 |
| 3 | 6 | 0 | 1 | 1 | 0 | -2 | 7 | 150 | 1 | 0 | 0 | 1 | 0 | 1 | 1 | 0 |
| 4 | 1 | 0 | 0 | 0 | 1 | -1 | 6 | 169 | 1 | 0 | 1 | 0 | 1 | 0 | 0 | 1 |
| 5 | 0 | 0 | 0 | 0 | 0 | 0 | 5 | 170 | 1 | 0 | 1 | 0 | 1 | 0 | 1 | 0 |
| 6 | 3 | 0 | 0 | 1 | 1 | 1 | 4 | 165 | 1 | 0 | 1 | 0 | 0 | 1 | 0 | 1 |
| 7 | 2 | 0 | 0 | 1 | 0 | 2 | 3 | 166 | 1 | 0 | 1 | 0 | 0 | 1 | 1 | 0 |
| 8 | 13 | 1 | 1 | 0 | 1 | 3 | 2 | 89 | 0 | 1 | 0 | 1 | 1 | 0 | 0 | 1 |
| 9 | 12 | 1 | 1 | 0 | 0 | 4 | 1 | 90 | 0 | 1 | 0 | 1 | 1 | 0 | 1 | 0 |
| 10 | 15 | 1 | 1 | 1 | 1 | 5 | 0 | 85 | 0 | 1 | 0 | 1 | 0 | 1 | 0 | 1 |
| 11 | 14 | 1 | 1 | 1 | 0 | 6 | -1 | 86 | 0 | 1 | 0 | 1 | 0 | 1 | 1 | 0 |
| 12 | 9 | 1 | 0 | 0 | 1 | 7 | -2 | 105 | 0 | 1 | 1 | 0 | 1 | 0 | 0 | 1 |
| 13 | 8 | 1 | 0 | 0 | 0 | 8 | -3 | 106 | 0 | 1 | 1 | 0 | 1 | 0 | 1 | 0 |
| 14 | 11 | 1 | 0 | 1 | 1 | 9 | -4 | 101 | 0 | 1 | 1 | 0 | 0 | 1 | 0 | 1 |
| 15 | 10 | 1 | 0 | 1 | 0 | 10 | -5 | 102 | 0 | 1 | 1 | 0 | 0 | 1 | 1 | 0 |

Fig. 2

DIGITAL HYDRAULIC SYSTEM

FIELD OF INVENTION

The present invention relates to a pressurized medium system. The invention relates to a stewing device for controlling the pivoting movement of a load. The invention relates to a rotating device for controlling the rotation of a load. The invention relates to a method in a pressurized medium system. The invention relates to a controller for controlling a pressurized medium system.

BACKGROUND OF THE INVENTION

In pressurized medium systems, a load is controlled by using actuators with working chambers having an effective area, on which the pressure of the pressurized medium is effective and causes a force that is, via the actuator, effective on the load. The magnitude of the force is dependent on both the pressurized effective area and the pressure which is, in conventional pressurized medium systems, controlled to produce variable forces. Typical examples include the transferring, lifting and lowering of a load, and the load may, in is physical form, vary from one system to another, being, for example, a part of a structure, an apparatus or a system, to be moved. The pressure control is normally based on adjustment with a loss, an in conventional resistance controlled solutions, the force control of the actuator is achieved by controlling the pressures of the working chambers in a stepless manner. Thus, the pressures are controlled by throttling the flows of pressurized medium entering and exiting the chamber. The control is implemented, for example, by means of proportional valves.

Typically, conventional systems have a pressure side, where the pressure is adjusted and which produces a volume flow of the pressurized medium, and a return side, which is capable of receiving the volume flow and where the prevailing pressure level is as low as possible, a so-called tank pressure, to minimize losses.

Known pressurized media include, for example, hydraulic oil, compressed air and water or water-based hydraulic fluids. The type of the pressurized medium is not limited, but it may vary according to the needs of the application and the requirements set.

Problems with conventional systems include susceptibility to failures and energy losses, particularly losses of hydraulic power and failures in control valves.

SUMMARY OF THE INVENTION

It is an aim of the present invention to introduce a new solution for implementing a pressurized medium system, which also gives significant energy savings compared to a majority of the systems presently in use.

The invention relates to a digital hydraulic system solution based on a method of control without throttling, devices which are applicable in the digital hydraulic system, including, for example, a pressure converter unit, a pump pressure converter unit, as well as methods, control circuits and controllers to be applied in controlling these.

The pressurized medium system according to the invention will be presented in claim 1. The stewing device according to the invention will be presented in claim 32. The rotating device according to the invention will be presented in claim 36. The method according to the invention will be presented in claim 41. The controller according to the invention will be presented in claim 43.

The system solution is configured either for controlling the force, acceleration, speed or position generated by the actuator driven by pressurized medium, or for controlling the acceleration, moment, rotary acceleration, angular speed, position, and rotation of the force generated by the device application comprising several actuators. In addition, or alternatively, the system solution is provided for the control of one or more energy charging units. In addition, or alternatively, the system solution is provided for the control of one or more pressure converter units and the respective conversion ratios. In addition, or alternatively, the system solution is provided for the control of one or more energy converter units, particularly pump pressure converter units and the respective conversion ratios.

A novel digital hydraulic system solution based on a method of control without throttling is provided, as well as the devices to be applied in it. An important feature of the digital hydraulic system is the recovery of kinetic or potential energy returning during the working movements of the actuator, into charging circuits.

The pressurized medium circuit which is applied in the digital hydraulic system and which will also be called a charging system hereinbelow, comprises two or more pressure circuits having different pressure levels and being also called charging circuits. Each charging circuit typically comprises one or more pressurized medium lines connected to each other and having the same pressure. In the following description, for the sake of simplicity, the focus will be primarily on a system solution comprising two charging circuits. A person skilled in the art can easily apply the presented principles to a system solution comprising three or more charging circuits as well.

The present examples will discuss a high-pressure charging circuit and a low-pressure charging circuit, which do not refer to any specific absolute pressure level but primarily to the difference in the pressure of said charging circuits. The pressure levels are selected to be suitable for each application. If the system solution comprises several high-pressure charging circuits or low-pressure charging circuits, it is preferable that also in this case the pressure levels of the charging circuits differ from each other.

When discussing a high-pressure charging circuit, the designations HP, HP line or HP connection will also be used; and when discussing a low pressure charging circuit, the designations LP, LP line or LP connection will also be used. The energy needed by the charging circuits is supplied by one or more charging units. In one example, energy is supplied into the charging circuit via one or more pressure converters from one or more other charging circuits.

The presented system, which comprises two or more charging circuits capable of supplying power and which uses digital hydraulic actuators based on a method of control without throttling, is called a low resistance digital hydraulic system (LRDHS). The power to be supplied from one or more charging circuits of a lower pressure level (LP) is often a substantial part of the power to be utilized in the system, and thereby the pressure levels of the charging circuits of a lower pressure level have a significant effect on the power production, controllability and energy consumption of the actuators.

It is characteristic to each charging circuit that it is capable of generating the required pressure and of both feeding and receiving a volume flow. Preferably, the pressure levels of the different charging circuits are evenly graded with each other.

A charging unit refers to a pressurized medium circuit that brings energy into the charging circuits of the charging system from the outside of the charging system, via a pump unit. The charging unit comprises a pump unit as well as a control and safety valve system, by means of which the suction line and the pressure line of the pump unit can be connected to any charging circuit. Preferably, the suction line and the pressure line can also be coupled to a pressurized medium tank.

Normally, one or more energy charging units of a higher pressure level are connected to an HP charging circuit, and in a corresponding manner, one or more energy charging units of a lower pressure level are connected to an LP charging circuit. The charging unit is, for example, a hydraulic accumulator or another energy accumulator which utilizes, for example, a spring load or gravity effective on the load, that is, potential energy. A potential energy accumulator and a digital hydraulic actuator connected to it can be used as an energy charging unit. The principle of operation of the digital hydraulic actuator will be explained further below in this description.

Digital hydraulic actuators coupled to each other can be used as pressure converters, by means of which power transfer between different charging circuits is possible without a significant energy consumption. Said digital pressure converter units (DPCU) can also be utilized when an actuator in uninterrupted operation is coupled to the charging circuit. In the pressure converter unit, the power transfer is based on utilizing the effective areas of the actuators and on the method of control without throttling.

By coupling the pressure converter unit to an external energy source that moves a movable part of the pressure converter unit, said digital pressure converter pump unit (DPCPU) can be used to supply energy to the charging circuits when the kinetic energy is converted by means of said actuators to hydraulic energy, that is, to the pressure and volume flow of the pressurized medium.

A digital actuator refers particularly to a cylinder having effective areas coded in a binary or other way, which areas are connected to the charging circuits by using different coupling combinations and the control without throttling. Typically, force control or force adjustment is in question.

The digital hydraulic slewing drive comprises one or more actuators having one or more chambers and based on a control without throttling, which actuators, together with one or more gear racks and gear wheels coupled to one or more actuators transform the linear movement to a limited pivoting movement. Typically, moment control or moment adjustment is in question.

The digital hydraulic rotating drive comprises two or more actuators having one or more chambers and based on the control without throttling and mechanically coupled to a wobbler. It is typically moment control or moment adjustment achieved via the force control of the actuators.

The system makes it possible to connect two or more charging circuits having different pressure levels, via control interfaces to one or more digital hydraulic actuators. The actuator unit formed by one or more actuators is thus used either as an actuator for moving a load, a pressure converter unit, a pump pressure converter unit, a pump, or simultaneously a combination of any of the above-mentioned devices. Actuators and actuator units can be coupled to a load and to each other either physically or hydraulically, depending on the application.

The technical advantages and differences of the system compared to conventional solutions are clearly better energy efficiency, controllability, simplicity of the components and the construction, modularity, and the control of failures. In conventional resistance controlled solutions, the force control of the actuator is achieved by stepless adjustment of the pressures of the working chambers. Thus, the pressures are adjusted by throttling the medium flows entering and exiting the working chamber. The present system, instead, comprises an alternative way of controlling the actuator operating with significantly few throttles and with simple valves and a simple system structure and based on force adjustment, by using only given discrete, predetermined but adjustable pressure levels (for example, HP and LP charging circuits). The force control is achieved by adjusting the force gradually by utilizing charging circuits with evenly graded pressure levels and the effective areas of the actuators coupled to them. The presented method of control, in combination with the actuator or actuator unit equipped with effective areas encoded, for example, in a binary or another way, enables a significantly lower energy consumption compared with conventional control methods. The system also allows high maximum velocities and is very accurate to control and to position.

In conventional proportional throttling control, the speed of a mechanism connected to the actuator is adjusted in a way directly proportional to the cross-sectional area of the opening of the throttling regulating member, wherein errors in adjusting the regulating member are reflected directly in the speed of the mechanism to be adjusted. In conventional solutions, a significant factor determining and limiting the accuracy of regulation is the optimization of the regulating member according to the application.

In digital throttling adjustment, inaccuracies in the adjustment of the speed of the actuator can be reduced by using several on/off valves connected in parallel as the regulating member, wherein, with a given pressure difference, certain controls (so-called set point, or control value) of the on/off valves are achieved by using certain discrete speed values which are, with a high probability, close to predicted values. Thus, a position response curve receives certain angular coefficients, as the speed receives certain discrete values. The error in the achieved speed and the coarseness of the angularity of the position response curve will depend on the resolution of the speed adjustment, that is, the number of openings available and thereby the valves.

In the presented digital system based on a control without throttling and having an acceleration adjustment, the acceleration of a mechanism coupled to the actuator is controlled in proportion to the force production of the actuator which, in turn, is controlled by connecting each charging circuit and thereby also each available pressure level to the available effective areas in such a way that the required force production is realized in the best way.

The speed adjustment is achieved by means of a speed feedback, and the speed response curve receives certain angular coefficients when the acceleration receives certain discrete values. The coarseness of the angularity of the speed response curve will depend on the resolution of the acceleration adjustment. Thus, the position response curve will be mathematically one degree more controlled when compared with direct speed control by throttling.

In the presented system, theoretically any speed value can be achieved, the speed error remaining very small. The factors limiting the resolution of the speed adjustment are thus the resolution of the acceleration control, the sampling period of the control system, the response times of the control interfaces, the time taken for state changes of the working chambers, and the measuring accuracy of the sensors. The resolution of the acceleration adjustment will depend on the number of working chambers available and the encoding of their areas, as well as the number of charging circuits to be connected to the working chamber and having different pressure levels, as well as the pressure levels of the charging circuits and the relationships between and differences in the pressure levels of the charging circuits. On the other hand, any inaccuracy in the throttling of the regulating member, caused for example by variation in the load force or pressure, and any adjustment error caused by this will not occur in the present method of digital hydraulic control. In this respect, the system has, under all circumstances, excellent controllability and manageability compared to conventional systems which are controlled by throttling.

When the system comprises several separate actuators which have an effect on the same piece or on the same point of impact or different points of impact in the same piece, either from the same direction or from different directions, the force produced by each actuator can be controlled either separately, irrespective of each other, or having an effect on each other, to obtain a desired direction or magnitude of the sum force, i.e. the total force, generated by the actuators. Said sum force is effective on the piece acting as a load, and causes an acceleration, a deceleration, or the cancelling out of the load force. To make said sum force have a desired magnitude and direction, the control system has to scale the control of the force of the actuators on the basis of a variable or variables measured from the system or determined in another way.

The uses of the system may vary almost without limits, but typical applications of digital hydraulic actuators include various applications of turning, rotating, lifting, lowering, driving force transmission and movement compensation, such as, for example, sea swell compensation. The system is most suitable for uses, in which there are relatively significant inertial masses to be accelerated and decelerated in relation to the force production of the actuator, wherein considerable energy savings can be achieved. The system is also very suitable for uses in which there are several actuators to be controlled, acting simultaneously at varying loading levels.

Uses of the present system may also include applications in which the actuator is used to generate a holding force in such a way that the actuator either yields to external stimuli or alternatively resists them, that is, tends to generate a counter-force of a corresponding magnitude and thereby to keep the movable piece stationary. The number of actuators to be used in the same system may vary, as well as the number of actuators to be connected to the same part of the same piece or mechanism. In particular, the number of actuators connected from the same piece or part (for example, machine frame) to the same piece or part (for example, a boom or a lifting arm) is significant in view of the control properties, energy consumption and the optimal control of failures of the actuator unit formed between said pieces.

BRIEF DESCRIPTION OF THE DRAWINGS

The invention will be described in more detail by means of some examples and with reference to the appended drawings.

FIG. 2 shows a state table to be used for controlling the system shown in the figure.

MORE DETAILED DESCRIPTION OF THE INVENTION

Control Interface

Figure 1:
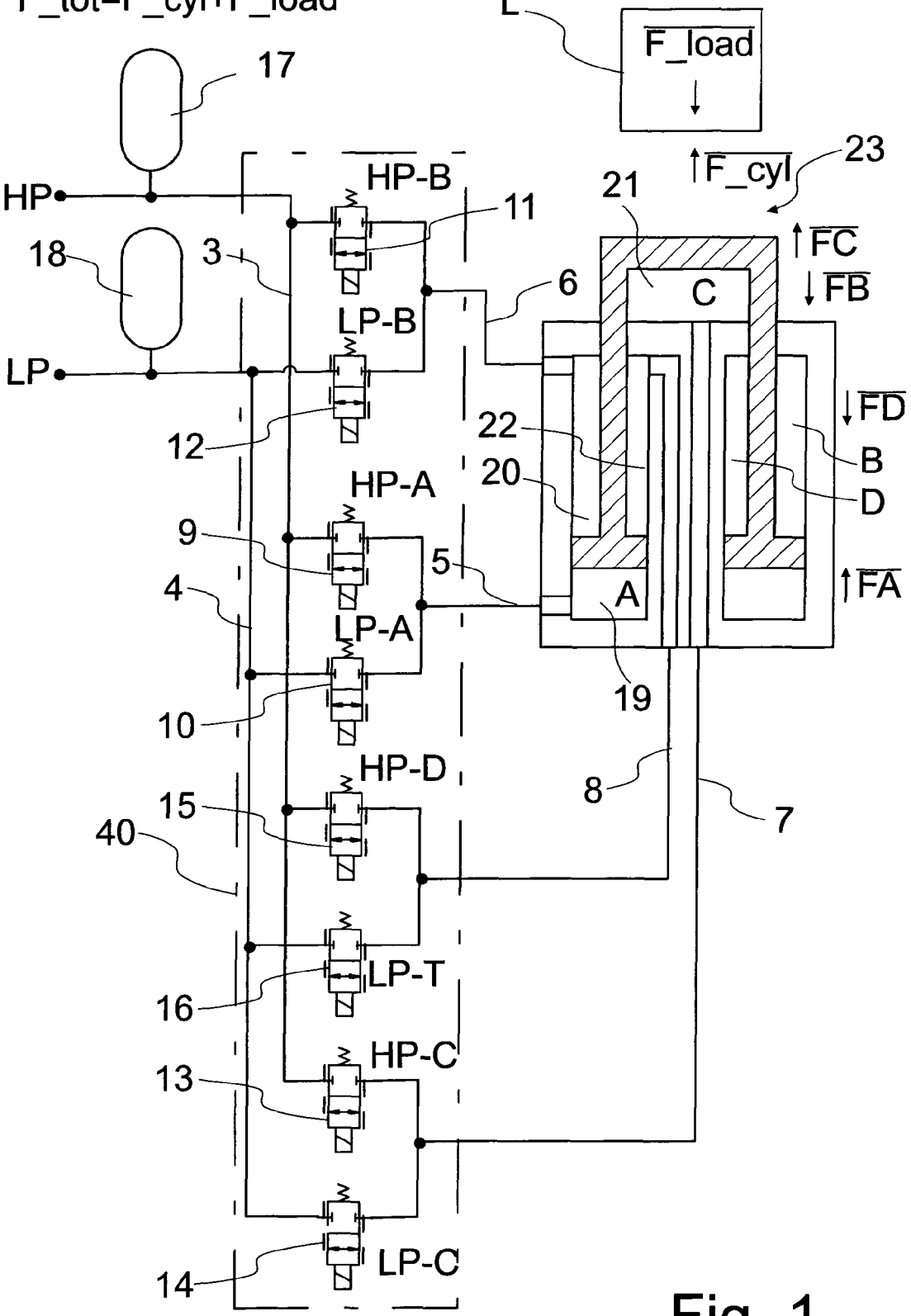
FIG. 1 shows a system according to an example of the invention, utilizing an actuator which is a cylinder comprising four working chambers and driven by pressurized medium.

The entry and return of pressurized medium into and from the actuator are controlled by means of control interfaces. The actuator comprises one or more working chambers operating on the principle of displacement. Each control interface has one or more control valves connected in parallel. The control valves are preferably fast shut-off valves with a considerably low pressure loss, for example electrically controlled on/off valves, and if the valves are in parallel on the same line, together they will determine the volume flow in the line. Depending on the control, each working chamber of the actuator is separately either shut off or connected via the control interfaces to a charging circuit, for example either an HP charging circuit or an LP charging circuit in a dual pressure system. Such a method of control, in which the control interfaces leading to the working chamber of the actuator and comprising one or more valves are always either completely open or shut off, is called, in this description, a method of control without throttling.

The control interfaces operate in such a way that the valve, or all the parallel valves, of the control interface are controlled to be either open or closed. The control of the control interface may thus be binary, wherein the setting is either one (control interface open, on) or zero (control interface closed, off). The necessary electrical control signal for the valve can be generated on the basis of the setting.

Digital Hydraulic Actuator

The operation of the control system of the digital actuator requires that the system comprises at least one actuator with at least one working chamber. The force component generated by the working chamber is based on the effective area of the working chamber and on the pressure effective in the working chamber. The magnitude of the sum force generated by the actuator is the calculated product of said factors. In this embodiment, preferably, the load force of the load controlled by the actuator, that is, the force effective on the actuator, is stronger in magnitude than the opposite force component generated by the pressure of the LP charging circuit in the actuator, and smaller in magnitude than the opposite force component generated by the pressure of the HP charging circuit in the actuator, to achieve a force control with at least two levels for controlling the load.

In one embodiment, the system comprises at least one actuator with at least two working chambers, whose effective areas differ from each other so that a force control with at least 4 levels is achieved in a dual-pressure system. The force components generated by the different working chambers are effective in either the same direction or in different directions, depending on the system and on the behaviour of the load to be controlled. Each working chamber is capable of generating two inequal force components. In a system comprising two pressure levels, the ratio between the areas is preferably 1:2, to achieve a force control of even step levels. A corresponding system is achieved by two single-chamber actuators which satisfy, for example, the ratio 1:2 between the areas. More force levels are obtained, for example, by increasing the number of working chambers, either in the same actuator or by adding separate actuators and connecting them to the same load.

More force levels are also obtained by increasing the number of charging circuits with different pressure levels coupled to the actuator. In this case, the number of force components and simultaneously force levels produced by the actuator is a power function, in which the base number is the number of charging circuits with different pressure levels connected to the actuator, and the index is the number of working chambers in the actuator. Preferably, the effective areas of the working chambers differ from each other, and the pressure levels of the charging circuits connected to the actuator differ from each other.

Also preferably, the ratios between the effective areas of the working chambers follow a series $M^N$, in which the base number M is the number of charging circuits to be connected to the actuator, and N is a group of natural numbers (0, 1, 2, 3, . . . n), when also the pressure levels of the charging circuits that can be coupled to them are evenly graded, to achieve an evenly graded force control, when the effective areas are coupled either to the HP charging circuit or the LP charging circuit, or to other charging circuits by utilizing various connecting combinations.

Particularly in a system comprising two charging circuits (an HP charging circuit and an LP charging circuit), the ratios between the effective areas of the working chambers preferably follow the series $M^N$, in which the base number M is 2 and the index N is the group of natural numbers (0, 1, 2, 3, . . . n); that is, the series 1, 2, 4, 8, 16, etc. formed by the weighting coefficients of bits in the binary system, to achieve an evenly graded force control, when effective areas are coupled either to the HP charging circuit or the LP charging circuit, by utilizing various coupling combinations.

Evenly graded means that the step from one force level to the next one or from one pressure level to the next one has a constant magnitude. The force levels are formed as various combinations of several force components generated in the actuator, making up a sum force. The ratios between the areas may also follow a different series, for example the series 1, 1, 3, 6, 12, 24, etc., or a series according to the Fibonacci or PNM encoding methods. By increasing equal areas or, for example, areas different from the binary series, it is possible to obtain more force levels, but at the same time, also redundant states are obtained which do not increase new force levels but the same sum force of the actuator is achieved by two or more coupling combinations of the control interfaces.

The number of coupling combinations is formed as a power function in such a way that the base number is the number of different pressure levels to be coupled to the working chambers, and the index is the total number of working chambers. The system comprises at least one actuator that is effective on the load. When two actuators with 4 chambers are used in a dual-pressure system, the number of states and coupling combinations of the system increases to the figure of $2^8=256$, because the total number of working chambers is 8. If two or more identical actuators are coupled to be effective on the same point of action in the load, the states of the system are, for the most part, redundant with respect to each other. Said actuators are effective on the load from the same direction or from opposite directions, and the corresponding working chambers of the identical actuators are equal in size. If the different actuators are effective on the same point of action from different directions, it is possible to adjust the magnitude and direction of the sum force effective on the load in a desired manner. If the different actuators are coupled to different points of action in the load, the magnitude and direction of the sum force effective on the load as well as the magnitude and direction of the moment can be adjusted as desired.

A particular compact embodiment of the invention, which has sufficiently many levels for the adjustment and which can be applied in a versatile way, comprises an actuator with four working chambers, the ratios of their effective areas following the binary series 1, 2, 4 and 8, wherein a 16-level force control is achieved, which is evenly graded. The actuator is also configured in such a way that those force components generated by their working chambers, which have the largest effective area and second smallest effective area, are effective in the same direction. The force components generated by the other working chambers are opposite in direction.

In this context, force control or moment control or acceleration control refer to the control of the force or moment or acceleration, because, with certain coupling combinations of the control interfaces, the system always produces a given force or moment, whose achieving does not require a feedback coupling. With an actuator whose force production can be selected gradually, it is easy to implement a gradual acceleration control, in which the acceleration is directly proportional to the so-called effective force formed as a sum of the sum force generated by the actuator and the other force components effective on the load. In the acceleration control, the system will need, for the feedback, the magnitudes of the load force that loads the system and of the inertial mass of the load, to conclude the produced sum force, at which the desired load acceleration becomes true. In the easiest way, however, the presented system can be applied in such applications in which the inertial mass of the load remains approximately constant, wherein the only data remaining for feedback is the load force that loads the system.

The acceleration-controlled system can be expanded to a speed-controlled one by means of a speed feedback coupling. The speed-controlled system can be expanded further to a position-controlled one by means of a position feedback coupling.

A requirement for the reproducibility to be achieved with a given guideline value that is randomly selected for acceleration, angular acceleration, speed, angular speed, position, or rotation, is that with the value zero (0) for the relative control of the system, the acceleration of the actuator should be approximately zero. The acceleration of the moving part of the actuator, force-controlled with a discrete constant control value, is, however, strongly dependent on the load force that loads the actuator. Consequently, a term must be added to the control value to compensate for the load force, and this term is called, in this document, the acceleration zero point of the control. With this control value, the acceleration of the actuator and simultaneously of the load is kept as close to zero as possible. The generation of the compensating term is implemented either empirically, by estimating the effect of the load force, by tabulation, by applying integrating adjustment, by estimation from sensor data.

Because the system is capable of producing only discrete control values to the control interfaces, it is not necessarily possible to keep the load to be controlled by the system totally stationary by any given discrete control, but for this, the state of the control of the system has to be changed repeatedly between two different states which produce opposite accelerations. The state changes taking place in the actuator are not completely without losses, but energy is consumed, among other things, due to the compressibility of the pressurized medium when the pressure level is raised in any working chamber. Therefore, preferably to keep the load and the respective mechanism in place, all the control interfaces are switched off, so that the mechanism is locked stationary in a so-called locking state. It is practical to implement this function in such a way that the priority of the control of the locking state is higher than that of the control of the control interfaces, and that said controls do not affect each other. When the locking state is turned on, all the control interfaces are switched off, irrespective of what would have been the coupling combination of the control interfaces in case the locking state were not turned on.

Excluding the locking state, the states of the pressure levels of the working chambers can be represented by the numbers zero (0), which refers to the lower pressure (for example, connection to the HP charging circuit), and one (1), which refers to the higher pressure (for example, connection to the LP charging circuit). In this way, the states of the working chambers can be expressed in an unambiguous way by a single binary number at each moment of time, when, in addition, the working chambers are always referred to in a predetermined order. The binary number consists of four numerals, if there are 4 working chambers. In this description, digital control refers to a method of control, in which two or more pressure levels are used, and the actuator or actuator unit utilizing them has a limited number of discrete force levels, whose number is based on the number of working chambers and particularly the combinations of different pressure levels connected to the different working chambers.

Because the throttles of the volume flows are very unimportant, the system allows high maximum speeds, when the piston stroke of the actuator is long. The high speeds of the piston of the actuator require high volume flows into or out of the working chambers of the actuator, according to the principle of displacement. For this reason, the control valves must, if necessary, pass such high volume flows that it is possible to introduce pressurized medium into the expanding working chamber at the necessary speed from the desired charging circuit without the occurrence of disturbing cavitation.

An actuator equipped with effective areas based on the binary series is, by utilizing the so-called control without throttling, useful in applications in which the inertial mass of the load reduced to the actuator is large. Thus, large amounts of kinetic energy is bound to the load during accelerations and potential energy in lifting movements, which energy can, in connection with deceleration or lowering of the load, be returned to any of the charging circuits and utilized again. Thanks to the method of control without throttling and the use of effective areas, this is possible and can also be implemented irrespective of the magnitude of the static load force, as long as the value of the static load force is within the range of force production of the actuator. The range of force production refers approximately to the range of force production remaining between the maximum and minimum values of the discrete forces that can be achieved at each time.

The greatest benefits of the system are obtained in large movements that bind and release forces, for example in slewing drives, in which a strong force or moment is needed for accelerating a large mass but in which a very weak force or moment is needed during steady motion, and a strong braking force or moment is needed at a braking stage. The advantage is here that during the steady motion, the system uses very little power, and only the losses of friction and viscosity need to be compensated for. The control is performed by selecting the suitable effective areas and the pressure effective on them either from the HP circuit or the LP circuit for use. Consequently, a suitable force level is thus selected for each control situation.

The system also saves energy in the same way in such applications, for example in lifting applications or driving transmissions (for example, driving up or down a hill), in which a force or moment clearly different from zero, a so-called holding force or holding moment, is needed to produce zero acceleration of the load. Thus, during steady motion in one direction, energy is bound to the load or a mechanism relating to it, by leading pressurized medium from the charging circuit of the higher pressure level into the actuator or actuator unit. At the same time, energy is transferred into the charging circuit of the lower pressure level, to which the compressing working chamber of the actuator is coupled. When moving in the opposite direction, energy is returned from the load or mechanism into the system, when pressurized medium returns from the actuator to a charging circuit. Thus, during the steady motion, the effective areas of the actuator can be selected so that the sum force generated by the actuator is close to the holding force or holding moment needed, but in such a way that the power input in the system covers the losses of friction and viscosity.

Compared with conventional systems, the presented system saves energy also in lossy applications, which may include, for example, movements with high friction, such as the propulsion or traction of a piece on surfaces with friction. In this case, preferably such a control and such a respective effective area are selected for use by each actuator in different situations, that overcome the frictional force or moment resisting the motion and produce the desired kinetic speed. Thus, each actuator is always optimally dimensioned in relation to the pressures of the charging circuits used, wherein each actuator consumes as little energy as possible.

Because of frictional and viscous losses and losses in state changes of the control interfaces, all the energy input in the system cannot be returned to the charging circuit.

The method of controlling the system performs automatically as much energy collecting as possible every time when kinetic or potential energy is released from the load or the mechanical system relating to it, for example during the stages of braking and/or lowering of the inertial mass. Thus, those effective areas and working chambers which previously generated the force components accelerating and/or lifting the inertial mass, contribute to the energy collection. Said working chambers are connected via the control interface to the charging circuit, to which energy is to be returned or transferred.

Charging System

In view of the operation and energy savings of the system, it is essential that all the charging circuits connected to the digital hydraulic actuator are capable of both supplying and receiving volume flow without radically changing the pressure levels of the charging circuits.

By means of the charging system, it is possible to transfer energy between said energy charging units whenever needed. If the working cycle of the system is energy binding (lifting a load, for example a bulk, to a higher level), the required energy is introduced into the system, for example, by pumping pressurized medium, for example, from the LP circuit to the HP circuit by means of a pump unit. If the working cycle is energy releasing (lowering a load, for example a bulk, to a lower level), said energy can be converted to hydraulic power and utilized according to the need or stored in an energy charging unit. If storing is not possible, the hydraulic power is converted back to, for example, kinetic energy by rotating a motor or an electric generator in such a way that pressurized medium is led from the HP circuit to the LP circuit. The conversion is carried out, for example, by means of said charging unit or another corresponding energy converter. The working cycle of any actuator of the same system may comprise both energy binding (for example, acceleration of a mass, hoisting of a load) and energy releasing (for example, braking of a mass, lowering of a load) work stages. When the system comprises several actuators, the different actuators may have both energy binding and energy releasing work stages at the same time.

A load sensing system (LS system) is the most typical system solution according to the prior art, which is a system irrespective of the load pressure and controlled by the volume flow, and it allows a pressure loss consisting of not only the load pressure but also a pressure loss of the pipe system and the pressure difference setting of the throttle control of the volume flow of the pressurized medium (typically about 14 to 20 bar). In drives coupled in parallel, the operating pressure of the system is adjusted, in a system operating normally under several parallel drives simultaneously, according to the highest load pressure level, and according to the actuator, the pressure difference over the control throttle of the volume flow is kept constant by means of the pressure compensators, and energy is thus wasted in the form of losses in them.

As the digital hydraulic system based on a method of control without throttling comprises several actuators whose working cycles may be placed in almost any way with respect to each other in time, the system is clearly more energy efficient than the LS system according to the prior art. In the digital hydraulic system, it is possible in each actuator to select a suitable effective area for use, depending on the available pressure level and the need of force production, to achieve the desired force production and kinetic speed with the minimum energy consumption.

The digital hydraulic system is not sensitive to interference caused by pressure variations in the pressure feeding circuits (charging circuits) either, because the system adapts to them by utilizing the effective areas. In both the conventional systems and the presented system of a novel type, the pressure levels of the charging circuits can vary even clearly when the power need of the actuators exceeds the power production capacity of the charging unit. In the presented digital hydraulic system, the pressures of the charging circuits may vary freely within certain limits and the adjustability remains still good, and the pressure variations do not have a significant effect on the energy consumption. Preferably, the pressures of the charging circuits are measured continuously, to know the combination of the working chambers of the actuator for achieving the desired sum force. Thus, the amount of energy consumed also meets exactly the need. In the presented system, variations in the pressures of the charging circuits only cause problems if the changes are so strong that the static load force is no longer within the force production range of the actuator.

Example I of a Digital Hydraulic System

FIG. 1 shows an example of a system that is a digital hydraulic system based on the control method without throttling and consists of a four-chamber cylinder actuator driven by pressurized medium, charging circuits, energy charging units, and control valves of control interfaces.

The system comprises, as charging circuits, one HP line (high pressure line, P line) 3 and one LP line (low pressure line, T line) 4, a line 5 connected to chamber A of the actuator, a line 6 connected to chamber B of the actuator, a line 7 connected to chamber C of the actuator, and a line 8 connected to chamber D of the actuator. Hydraulic power to the charging circuits 3 and 4 is supplied, for example, by a charging unit, whose operation will be described further below.

The system also comprises control interfaces for controlling the connection of each chamber to the HP line and the LP line; in other words, control interface 9 (controlling the connection HP/P-A), control interface 10 (A-LP/T), control interface 11 (HP/P-B), control interface 14 (C-LP/T), control interface 15 (HP/P-D), and control interface 16 (D-LP/T).

The system also comprises an HP accumulator 17 connected to the HP line 3, and an LP accumulator 18 connected to the LP line 4. In this example, the system comprises a compact actuator 23 with four working chambers, of which two working chambers (A, C) operate in the same direction, extending the cylinder used as the actuator 23, and two working chambers (B, D) operate in the opposite direction, contracting the cylinder. The actuator 23 has an A-chamber 19, a B-chamber 20, a C-chamber 21, and a D-chamber 22. The actuator 23, in turn, is effective on a piece acting as a load L.

The HP line branches into each working chamber line 5, 6, 7, and 8 of the actuator via high-pressure control interfaces 9, 11, 13, and 15, respectively. The LP line branches into each working chamber line 5, 6, 7, and 8 of the actuator via low-pressure control interfaces 10, 12, 14, and 16, respectively. The lines 5, 6, 7, and 8 are directly connected to the working chambers 19, 20, 21, and 22, respectively. A pressure control valve can be connected to the line of each working chamber, if necessary. Said lines and control interfaces constitute the control circuit 40 needed for the control of the actuator 23.

In the system of FIG. 1 used as an example, the actuator 23 is also configured, with respect to the areas of the working chambers, in such a way that the area values proportioned to the smallest area follow the weighting coefficients of the binary system (1, 2, 4, 8, 16, etc.), so that the actuator 23 is also called binary encoded. The binary encoding of the areas is, in view of the force control implemented by digital control, the most advantageous way to encode the areas to obtain, with the minimum number of working chambers, the maximum number of different force levels so that the forces are evenly graded. The actuator has four working chambers, and each working chamber can be used in two different states which can be called the high-pressure state and the low-pressure state (corresponding to two different force components), wherein only either the HP line 3 or the LP line 4 is connected to each working chamber.

The force components $F_A$, $F_B$, $F_C$, $F_D$ produced by the working chambers are illustrated in FIG. 1. The states can also be indicated by zero (0, low pressure state) and one (1, high-pressure state). In this case, the number of state combinations becomes $2^n$, in which n is the number of working chambers, and 16 different state combinations of working chambers are achieved in said example, so that 16 different sum forces can be generated by the actuator, the magnitudes of the forces being evenly graded from the smallest to the greatest, thanks to the binary encoding. There are no redundant states, because each force level can only be produced by a single state combination, thanks to the binary encoding. There are no force components of equal absolute values either, because all the working chambers are different from each other. In this example, the directions of action of the different force components are partly opposite, and their sum force determines the force generated by the actuator and its direction of action, together with the pressure levels of the LP and HP circuits. Therefore, by adjusting the LP and HP pressure levels, the actuator can be used to generate sum forces in either one direction only or in two opposite directions. It will depend on the application, in which direction the sum forces are wanted or needed to be used.

In other embodiment examples, also other charging circuits can be connected to each working chamber, for example several HP lines or LP lines or both.

A controller included in the system of FIG. 1 controls the operation of the actuator and may be part of a larger control system controlling the system of FIG. 1 to provide a desired sequence of operation, relating to the production of a desired force, moment, acceleration, angular acceleration, speed, angular speed, position, or rotation. If the system comprises several actuators, it will also comprise respective controllers for them. A guideline value can be given either automatically or manually, for example by means of a joystick. The control system typically comprises a programmed processor that follows the desired algorithms and receives the necessary measurement data from sensors for the control of actuators. The control system controls, for example, controllers according to the functionality wanted from the system.

The different coupling combinations, with which the actuator produces different sum forces, of the valves, by means of which the control interfaces 9 to 16 are implemented, are arranged in a so-called control vector in the controller so that the sum forces produced with the different states of the valves are in an order of magnitude, for example as shown in FIG. 2. This is possible, in the case of a cylinder 23 with binary encoded areas, by using an increasing 4-bit binary number in the selection of the states of the working chambers, wherein also the bits indicating the state of the working chambers 20 and 22 effective in the negative direction (the cylinder becomes shorter) are converted to their complements. In the binary number used for selecting the states of the working chambers and for controlling the actuator, the significance of each bit is proportional to the effective areas of the working chambers. In this way, the sum force produced by the actuator can be controlled in proportion to the indexing of the control combination selected from the control vector, in said control vector. The control combination refers to the combination of controls of the control interfaces.

FIG. 2 shows an example of a state table of a cylinder actuator with four chambers, corresponding to the system of FIG. 1. The effective areas of the working chambers are encoded with binary weighting coefficients: A:B:C:D=8:4:2:1. From the state table, it can be seen how the effective surfaces under different pressures are changed at constant intervals when proceeding from one state to the next one. For this reason, the force response produced by the actuator is also evenly graded.

In the column "u %", the index for the different controls is given as a decimal number. In the column "dec 0 . . . 15", the decimal number is given that corresponds to the binary number formed from the binary states (HP, LP) of the working chambers. In the columns A, B, C, and D, the binary states of the chambers are expressed in such a way that the state bit 1 represents high pressure (HP) and the state bit 0 represents low pressure (LP). In the columns "a/HP" and "a/LP", the effective areas connected to the HP and LP pressures of the actuator are indicated in relative numbers, assuming that said area ratios are met. In the column "dec 0 . . . 255", the decimal number is given that corresponds to the binary number formed from the binary states of the control interface. The columns A-LP, HP-A, B-LP, HP-B, C-LP, HP-C, D-LP, and HP-D contain the binary states of the control interfaces corresponding to each control (1, open, and 0, closed). It is obvious that with an increasing number of states of the working chambers, when the number of the charging circuits is increased, the states can be represented, for example, by the ternary system (numbers 0, 1, 2), the quaternary system (numbers 0, 1, 2, 3), or in another way.

Figure 3:
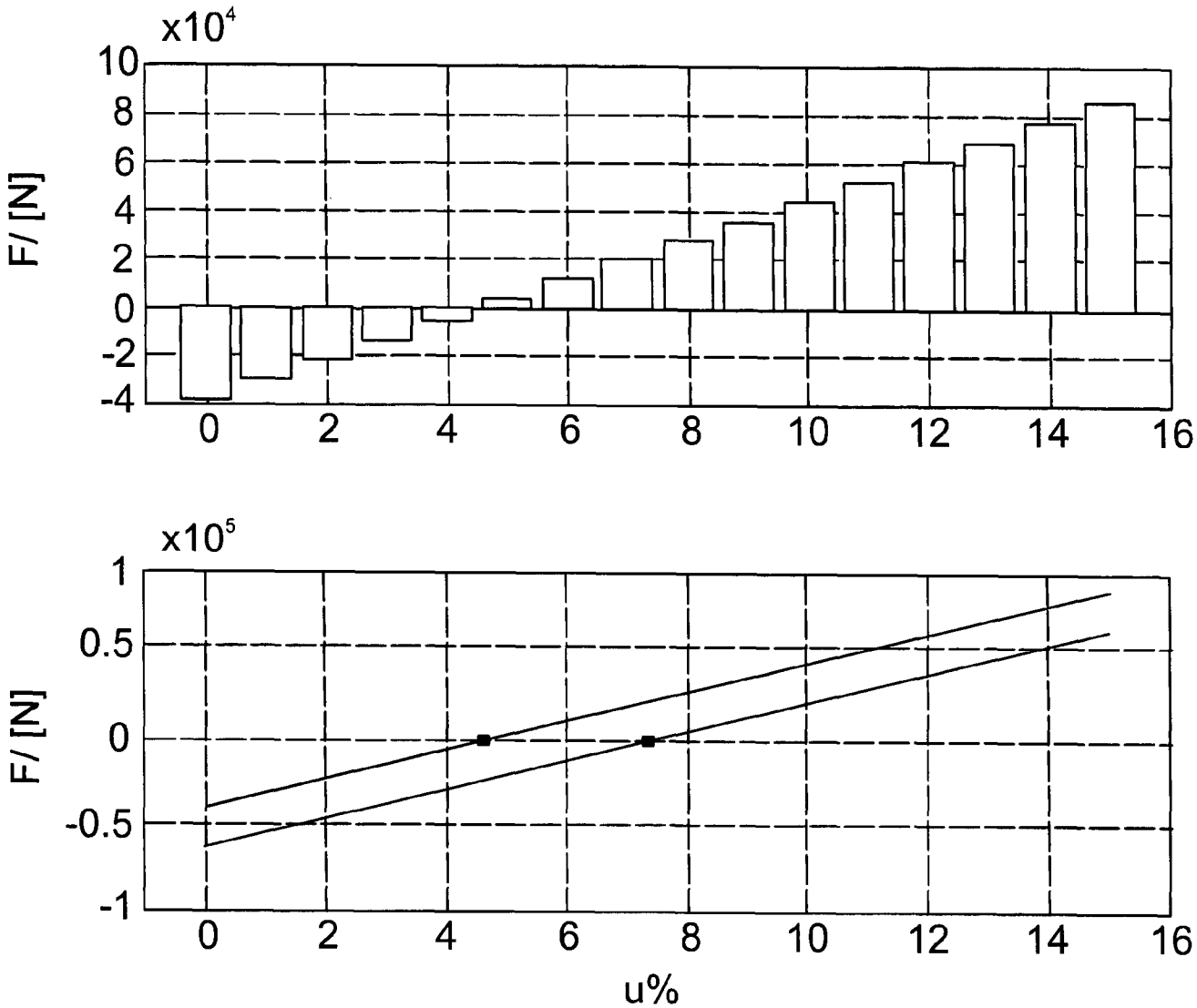
FIG. 3 shows the force grades generated by the system shown in FIG. 1.

FIG. 3 illustrates force graphs for the case presented in the state table example of FIG. 2 and for a four-chamber cylinder actuator with ideally binary encoded areas in accordance with, for example, FIG. 1. In this more detailed example, the diameter of the cylinder piston is 85 mm, the pressure of the HP circuit is 14 MPa, and the pressure of the LP circuit is 1 MPa. The higher graph shows, in an order of magnitude, the sum forces generated by the actuator, which are achieved with different coupling combinations of the working chambers by combining working chambers to the HP and LP circuit according to the state table of FIG. 2.

In the lower diagram, the higher curve illustrates the force production of the actuator by representing the graded sum forces as a continuous function. The lower curve illustrates the effective force production proportional to the acceleration of the piston or piston rod of the actuator, which can be calculated by adding the effect of an external load force, which is in this case compressing or resisting to the extension of the actuator, to the sum force produced by the actuator. The load force will depend on the application and on the load caused by the piece to be controlled. In this example, the compressing external force is assumed to be negative; in other words, it drops the curve of the effective force downwards, and the external tractive force, in turn, raises the curve of the effective force upwards and, in this example, contributes to the extension of the actuator. From the graphs, an approximate value can be retrieved for those control values or control values, at which the measured effective force or acceleration is zero. Zero force point refers to the approximate value for the guideline value, at which the effective force produced by the actuator is zero. Zero acceleration point refers to the control value, at which the acceleration of the moving part of the actuator is zero. In the case of a cylinder actuator, the moving part is its piston and piston rod, its frame being stable, if the load is connected to the piston rod. On the other hand, the moving part may be the frame that moves in relation to the piston and piston rod, if the load is connected to the frame. In the case of a binary actuator, the curve of FIG. 3 is a continuous function which is a first order polynomial, that is, a straight line.

Example II of a Digital Hydraulic System

Figure 11:
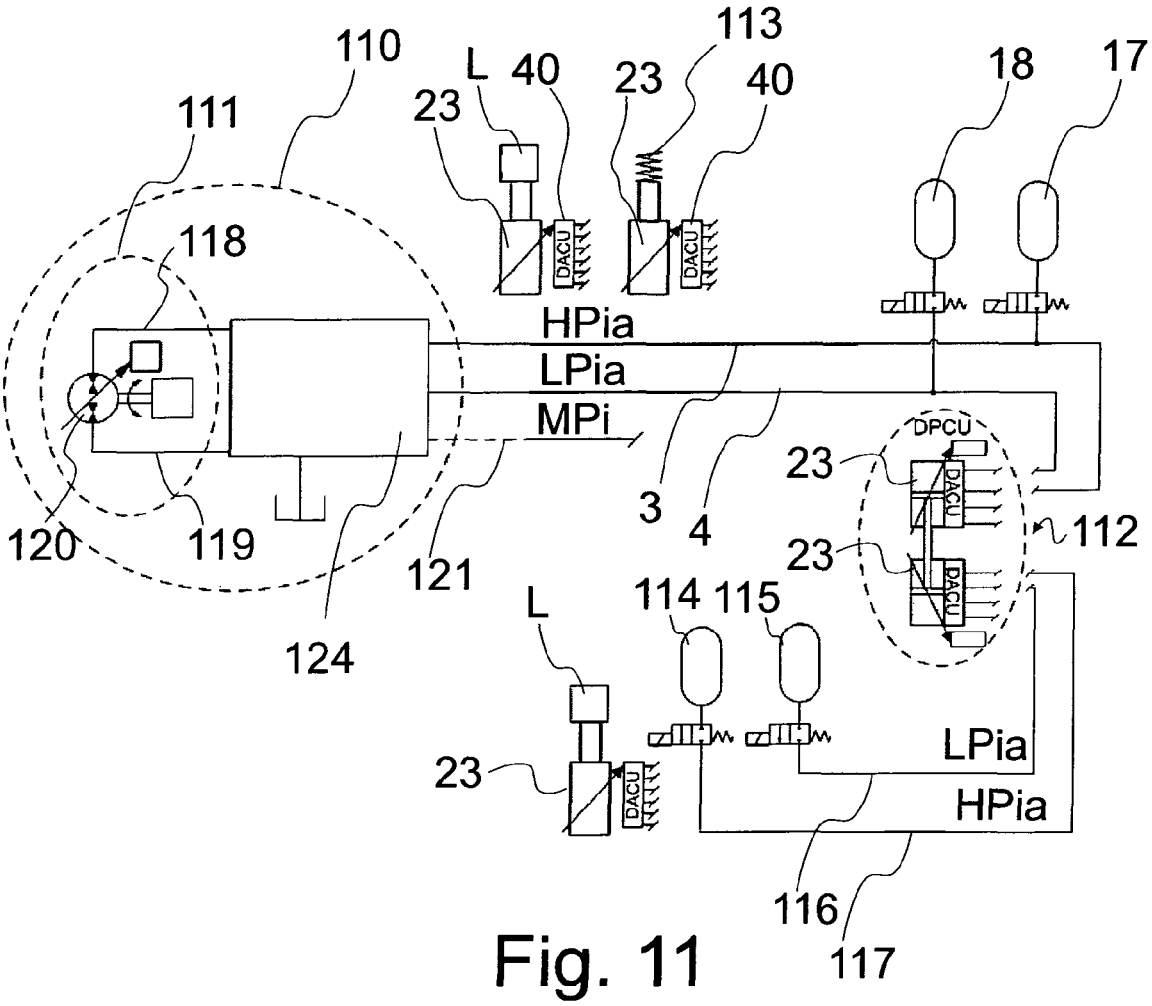
FIG. 11 shows a system according to another example of the invention.

FIG. 11 shows an example of a system that is also a digital hydraulic system based on the method of control without throttling. The other exemplary systems comprise one or more of the actuators of FIG. 11. In FIG. 11, the numbering of components corresponds to the numbering in FIG. 1 as far as there is a corresponding component. The system is thus one that applies digital hydraulic actuators based on the method of control without throttling. The system comprises at least one actuator 23 and two or more charging circuits 3, 4, and 121, from which hydraulic power can be supplied into the working chambers of the actuators 23. The actuator 23 together with the control circuit 40 (DACU) can also be used as a part of an energy charging unit; an example is the charging of potential energy in a spring 113 or in a load L. The load L may also refer to a load that is controlled, for example, by means of force control. One or more charging circuits are coupled to each actuator used as part of the energy charging unit. Two or more charging circuits are connected to each actuator controlling another load. The charging circuit is connected to the actuator by means of a control circuit 40 that comprises at least the necessary control interfaces (see FIG. 1) and by means of which each working chamber can be connected to a charging circuit, and typically said connection can also be closed. Preferably, any working chamber of the actuator can be both closed and connected to any charging circuit that belongs to the system. Each control interface is implemented with, for example, one or more on/off type valves. The valves are placed, for example, in a valve block comprising the necessary lines.

Figure 5:
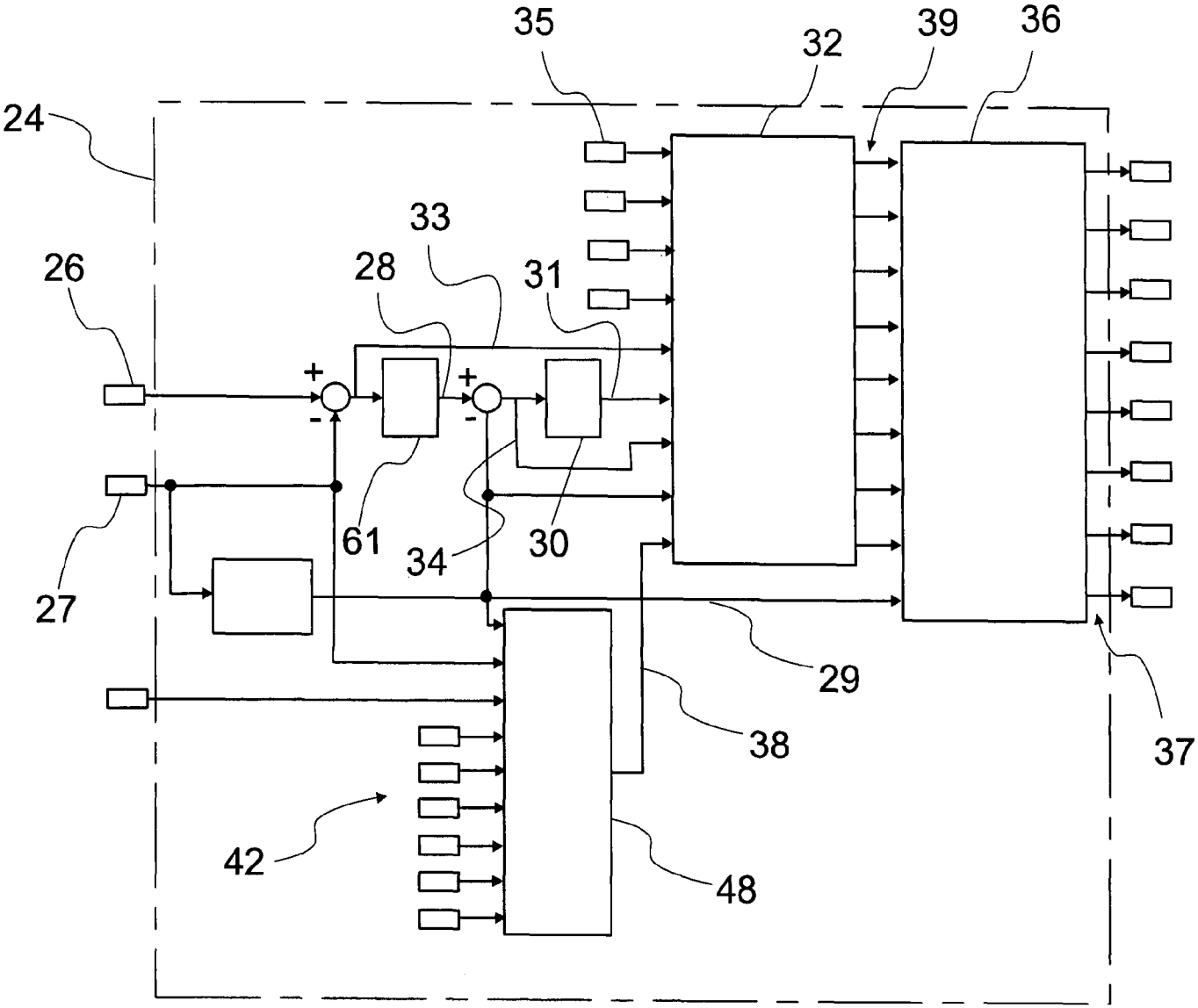
FIG. 5 shows a controller for use in controlling the system.

Each control circuit 40 together with the respective controller forms a digital acceleration control unit (DACU). The more detailed way of operation and the control algorithm of the controller will depend on the application of the actuator. In the figures, the charging circuits to be connected to said unit are indicated with the references HPi, MPi and LPi, in which i is an integer. The arrow included in the symbol of the actuator represents adjustability based on the use of different pressure levels and effective areas. One example of implementing the controller is shown in FIG. 5.

Figure 12:
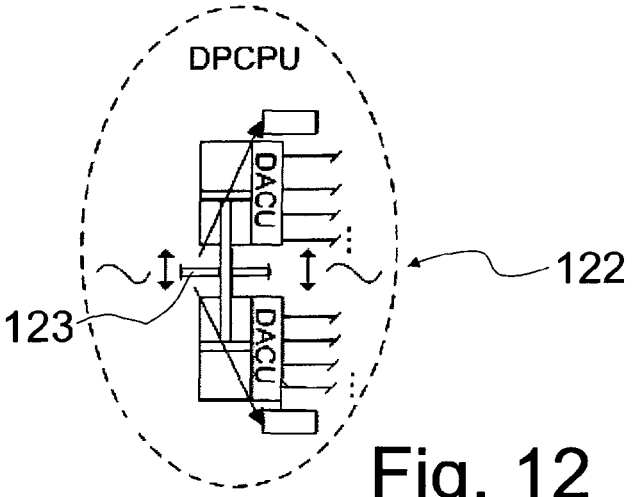
FIG. 12 shows the principle of operation of a pump pressure converter.

As shown in FIG. 11, the system comprises at least one charging unit 110, which generates the necessary hydraulic power to the charging circuits 3, 4 connected to it. One or more charging units may be connected to each charging circuit, or alternatively, no charging unit is connected to the charging unit if it is a charging unit (for example charging units 116 and 117 indicated with HPia, HPia and LPia, in which i is an integer) that is supplied with hydraulic power indirectly via another charging circuit or in another way (for example, pressure converter 112 of FIG. 11 or pump pressure converter 122 of FIG. 12). The charging unit 110 comprises one or more pump units 111 with, for example, an hydraulic pump unit 112 comprising a conventional hydraulic pump and its drive.

When the pump unit comprises several hydraulic pumps coupled in parallel or at least one pump containing such inequal capacities, which capacities can be controlled irrespective of each other, the hydraulic power can be transferred between charging circuits of several different pressure levels simultaneously.

The charging unit 110 also comprises a control and security valve system 124, by means of which each line of the pump unit, in this example the lines 119 and 118 of the pump unit, can be connected to any charging circuit irrespective of each other, or to a tank line and a tank T, if this is included in the system. By means of the control and security valve system 124, care is taken that the pressure level does not rise too high in the charging circuits or in the lines of the pump units.

If the system comprises charging circuits which are not connected to the same charging unit, energy can be transferred between said charging circuits by means of, for example, a pressure converter. As an example, the charging circuits HPi and HPia of FIG. 11 are mentioned, in which the transfer of energy is possible from two or more charging circuits via a pressure converter to two or more charging circuits simultaneously.

One or more energy charging units can be connected to each charging circuit. The energy charging unit is, for example, a conventional pressure accumulator 17 and 18, or a digital cylinder actuator 23 that charges energy for example on the load L or on a spring 113, in the form of potential energy. Energy can be charged as potential energy also in a compressible gas or in any other form of energy. The pressure of the charging circuits is kept on a desired level by means of energy charging units and charging units.

Figure 13A:
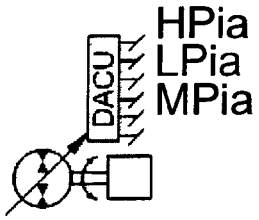
FIGS. 13*a*-13*d* show actuators for use in the system of FIG. 11.
Figure 13C:
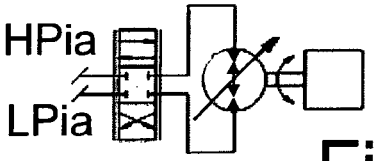
Figure 13B:
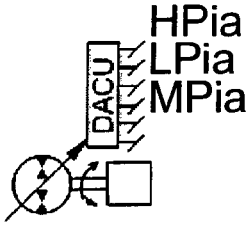
Figure 13D:
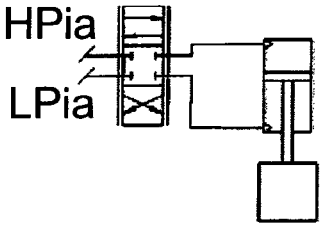

Both digital hydraulic actuators based on the method of control without throttling, and conventional actuators controlled by throttling control valves can be coupled to each charging circuit, as shown in FIGS. 13*c* and 13*d*.

Furthermore, one or more subcircuits can be connected to each charging circuit by using digital hydraulic actuators which are applied as pressure converters or pump pressure converters. A subcircuit is a charging circuit whose uninterrupted operation is dependent on energy introduced from another charging circuit. In other respects, the same principles apply to the subcircuits as to the other charging circuits.

Charging Unit

We shall next discuss the operation of the charging unit 110. A hydraulic pump unit 120 comprises one or more hydraulic pumps or pump motors which may each be either of the conventional type or pump motors, comprising one suction line and one pressure line, or digital hydraulic pumps or pump motors, comprising several lines which may be used both as suction and pressure lines, depending on the control. In this example, line 119 is the suction line of a conventional hydraulic pump, receiving a volume flow, and line 118 is, in turn, a pressure line that delivers a volume flow. It is the function of the control and safety valve system 124 to connect the line 119 to such a charging circuit from which pressurized medium is to be delivered, and to connect the line 118 to such a charging circuit, to which pressurized medium and hydraulic power are to be supplied.

The pumping algorithm of the charging unit 110, under its control unit, typically operates on the principle that the line 118 is always connected to such a charging circuit, in which the relative pressure slip from the minimum value of the target pressure window, or target pressure, is the greatest. In a corresponding manner, the line 119 is always connected to such a charging circuit, in which the relative pressure overflow from the maximum value of the target pressure window, or the target pressure, is the highest. If the pressure of any charging circuits does not exceed the maximum value or target pressure of the corresponding target pressure window, the line 119 is connected to the tank line (tank T), and in a corresponding manner, the line 118 is connected to such a charging circuit, in which the relative pressure slip from the minimum value of the target pressure window, or the target pressure, is the greatest. If the pressures of all charging circuits exceed the maximum value or target pressure of the corresponding target pressure window, the line 118 is connected to the tank line (tank T), and in a corresponding manner, the line 119 is connected to such a charging circuit, in which the relative overflow from the maximum value of the target pressure window is the highest. In this case, energy is transferred from the charging circuit via the pump unit 111 to, for example, kinetic energy, or to be utilized, for example, for the production of electric energy by means of a generator and chargeable batteries.

To prevent vibrations of the pump unit 111, the couplings are changed at sufficiently long intervals, for example, in coupling periods of at least 1 second. If the pressure of only one charging circuit differs from its target pressure or target pressure window, the line 118 can be kept connected as long as the target pressure has been achieved. If the pressures of all the charging circuits remain below the minimum values of the corresponding target pressure windows, the pressures are corrected in an alternating manner by means of said algorithm and by maintaining the relationships between the pressures the same as the relationships between the corresponding target pressures. Thus, the performance of the actuators remains good, even if the charging circuits were still at the charging stage and the target pressures were not yet achieved. If the pressures deviate in different directions from the corresponding target pressures, pressurized medium is removed from the charging circuit, in which the relative overflow of the target pressure of the pressure level is the highest, and pressurized medium is supplied into the charging circuit, in which the relative deficit of the pressure level from the target pressure is the highest.

In situations, in which any actuator requires immediately a large amount of power for moving the load, the charging of a given charging circuit can be prioritized for a moment or permanently over the charging of the other circuits, or a given charging circuit can be coupled for use by said actuator. The control unit is configured to implement said operations in the charging unit 110, controlling its components by means of appropriate control signals and on the basis of measurements which include particularly the pressure measurements of the different pressure circuits. The charging circuits and the lines of the charging unit are preferably equipped with pressure sensors connected to the control unit.

Controller of the Digital Hydraulic Actuator

We shall next discuss the controller used for controlling the system, which calculates, by means of a guideline value, the necessary control values for controlling the load by means of the actuator. The control values are, in this case, values describing the states of the control interfaces and the states of their control valves.

There are several possible controller alternatives, of which some suitable will be presented herein. It is a common feature for the different controllers that the controller calculates the optimal states for the control interfaces, that is, the positions of the control valves (open or closed). The calculation of the control takes place on the basis of given guideline values and measured variables. The digital outputs of the controller are used for setting the positions of the control valves.

The number of output combinations totals $2^n$, in which n is the number of outputs, when the states of the control interfaces are also described by the binary alternatives 0 and 1. Of these combinations, only some are used, because a situation is not allowed, in which both the HP circuit and the LP circuit were coupled to the same working chamber at the same time. The described situation would mean, for example, that both the control interface 11 (HP-B) and the control interface 12 (B-LP) were open, which would lead to a short circuit flow from the HP circuit to the LP circuit and the deviation of the pressure of the working chamber 20 from the pressure of both the LP circuit and the HP circuit. A short-circuit flow would also cause energy losses, which are to be avoided. The presented method of adjustment differs substantially from proportional adjustment, in which the kinetic state of the system is controlled by a single control valve in a stepless manner.

The operation of the controller 24 is illustrated in the figure on the level of a schematic diagram, which is also suitable for simulating the system. On the basis of principles presented in the schematic diagram, an expert in the field is capable of designing and implementing the required controller device (control algorithm/control software) that is connected to the system that controls the load. It is typically a processor suitable for signal processing and controlled by software, implementing certain computing algorithms. The controller comprises the necessary inputs and outputs for receiving and generating signals. The controller forms a part of the digital acceleration control unit (DACU).

Figure 4:
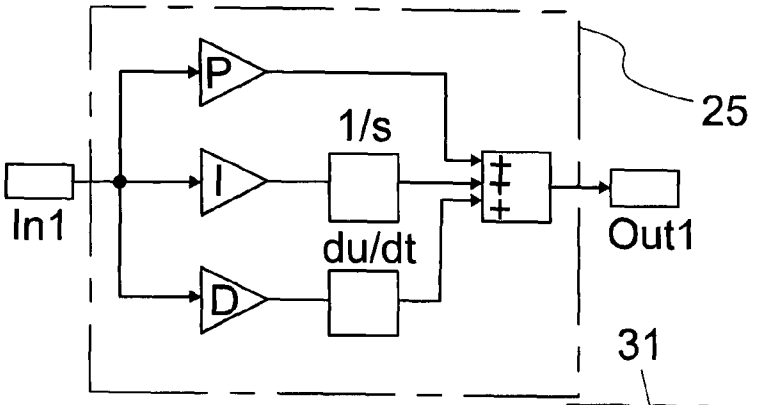
FIG. 4 shows the functionality of the adjustment coefficients of the control of the system.

When discussing control coefficients in this document, reference is made to a means 25 shown in FIG. 4 and known as such, that scales the input variable In1 in such a way that the output variable Out1 becomes the sum of the terms P (amplification), I (integration) and D (derivation) scaled with some control coefficients. The input is typically the remainder calculated from the set or guideline value on the basis of the measured value. The more accurate numerical values for the efficient will be found empirically or by calculations in connection with the tuning of the controller.

FIG. 5 shows a controller 24 for the four-chamber actuator shown in FIG. 1. A corresponding controller can also be applied in other actuators or actuator units having a corresponding encoding of work chamber areas. The principles of the controller 24 can also be expanded to other than four-chamber or binary encoded actuators.

A force-controlled system can be made acceleration-controlled by feedback coupling of acceleration data, as well as data on the force generated by the actuator, to the controller. On the basis of this, it is possible to calculate a compensation term that produces zero acceleration for the control, wherein the desired acceleration can be generated to the actuator, irrespective of the load force.

An acceleration-controlled system can be made speed-controlled by giving the controller a speed guideline value and comparing this with the speed data measured from the actuator (speed feedback). Thus, the force generated by the actuator is compared in proportion with the speed difference variable, that is, the difference between the speed guideline value and the actual value, or the speed data. The difference variable is scaled by a member shown in FIG. 4.

A speed-controlled system can be made position-controlled by giving the controller a position guideline value and comparing this with the position data measured from the actuator. Thus, the speed guideline value of the actuator, to be input in the speed control system, is adjusted in proportion with the position difference variable, that is, the difference between the guideline value and the actual value of the position. A position control system implemented in this way, based on controlling the force of the actuator, is one example of a so-called secondary control system.

The controller 24 of FIG. 5, adjusting the position of the actuator, performs secondary control and converts the calculated control value to a state combination of the control interfaces. The controller receives, as its inputs, the guideline value 26 for the position of the actuator and the position data 27, and calculates their difference, which is the difference variable of the position. The position difference variable is scaled in a position control block 61 (position control coefficients) to form a speed guideline value 28 by a member 25 shown in FIG. 4. Speed data 29 is subtracted from the speed guideline value 28, wherein the speed difference variable is obtained. The speed difference variable is scaled in a speed control block 38 (speed control coefficients) by a member 25 shown in FIG. 4 to form a force control value 31 which is saturated, for example, into a range from −1 to +1 and input in a control converter 32. The control value scaled in this way can be easily scaled further to form control values of the control interface. If the I-term in the coefficients of the speed control block 30 is zero, that is, the integrating control is not in use, the control value 31 is proportional to the desired acceleration, wherein the control value 31 can also be called a relative acceleration control value. When the integrating control is in use, the control value 31 approximates a variable proportional to the desired force production, wherein a term to compensate for the load force is not added to the control afterwards any more.

The function of the control converter 32 is primarily to convert the control value 31 to binary controls of control interfaces. If no integrating control is used, the control converter will also need, for this function, information about the load force effective on the actuator and will add a term proportional to the load to the control, to satisfy the desired acceleration. Furthermore, the control converter 32 examines the data obtained as real-time sensor data on the position difference variable 33, the speed data 29 and the speed difference variable 34, and concludes, on the basis of these, for example whether the system should be locked in position by closing all the control interfaces. When, for example, the given position guideline value 26 or the zero speed has been achieved with a sufficient accuracy, it is no longer worthwhile to continue the control, because energy is consumed in changing the states of the valves. The control converter 32 will also need a guideline value 35 on the type of locking state to be used. Alternatives may be, for example, 1) no locking in any situation, 2) locking on manually all the time (in an override type, that is, "by force"), 3) locking in use in view of the needs of the position control, 4) locking in use in view of the needs of the speed control.

The functionality of the control converter 32 can also be divided to several separate converters, for example in such a way that each converter controls the control interfaces of a single actuator. The control value 31 for acceleration, that is, the relative force control value, can be entered as input to all the converters which calculate the positions corresponding to the desired acceleration according to the loading situation.

Alternatively, the functionality of the control converter can be divided to modular parts onto the main level of the controller. Thus, it is possible to process controls of several actuators in the same parts of the control converter in such a way that the common operations are carried out for the vector-value control, scaled individually on the basis of some variables obtained from the system even before input in the parts of the control converter. Furthermore, alternatively, it is possible to generate the controls of several actuators in the same control converter from a single common discrete control of the system by utilizing various control vectors, that is, control conversion tables.

A delay block 36 is not necessary but it can be used to perform optimization effective on the functionality of the valves of the control interface. For example, the function of the delay block 36 may be to add a delay to the changes of the control values 37 of the valves on the ascending edges of the digital controls and, if necessary, to control the opening of the control interface when this is useful in view of energy consumption. The necessary delays are computed on the basis of, for example, the speed data 29 of the actuator.

We shall next discuss a controller of a speed-controlled system.

Figure 6:
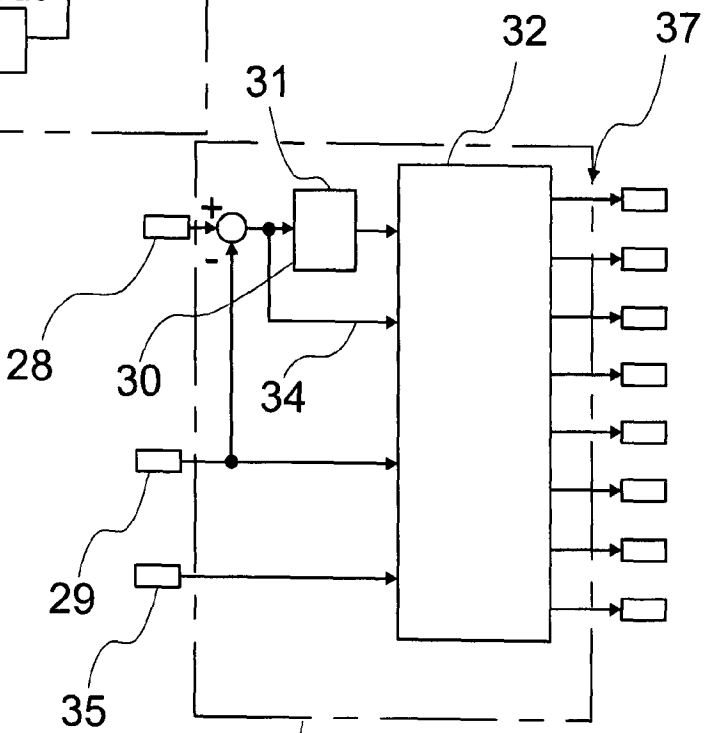
FIG. 6 shows an alternative controller for use in controlling the system.

As shown in FIG. 6, a speed-controlled system requires, for its operation, the speed guideline value 28 of the actuator and the speed data 29, which can be obtained, for example, as directly measured data from a speed sensor, or as estimated data from other measured variables, particularly the change in position with respect to the change in time, that is, by differentiating from the position data. A position control loop has been omitted around the speed control system. With respect to the other parts, the speed-controlled system operates in the same way as the position-controlled system of FIG. 5.

We shall next discuss a controller of an acceleration-controlled system.

An acceleration-controlled system may also require the speed data 29 of the actuator as feedback sensor data. However, this is not used for the control but, for example, for the needs of a locking system in the control converter 32, as shown in FIG. 5. Furthermore, the locking system will need data on either the speed difference variable or the state of the control value 31, that is, how much the control value differs from zero. With respect to the other parts, the force-controlled system operates in the same way as the position-controlled system of FIG. 5.

Also in speed and acceleration controlled systems, the intelligent addition of the opening delays of the control interfaces is useful with the delay block 36 of FIG. 5.

Figure 8:
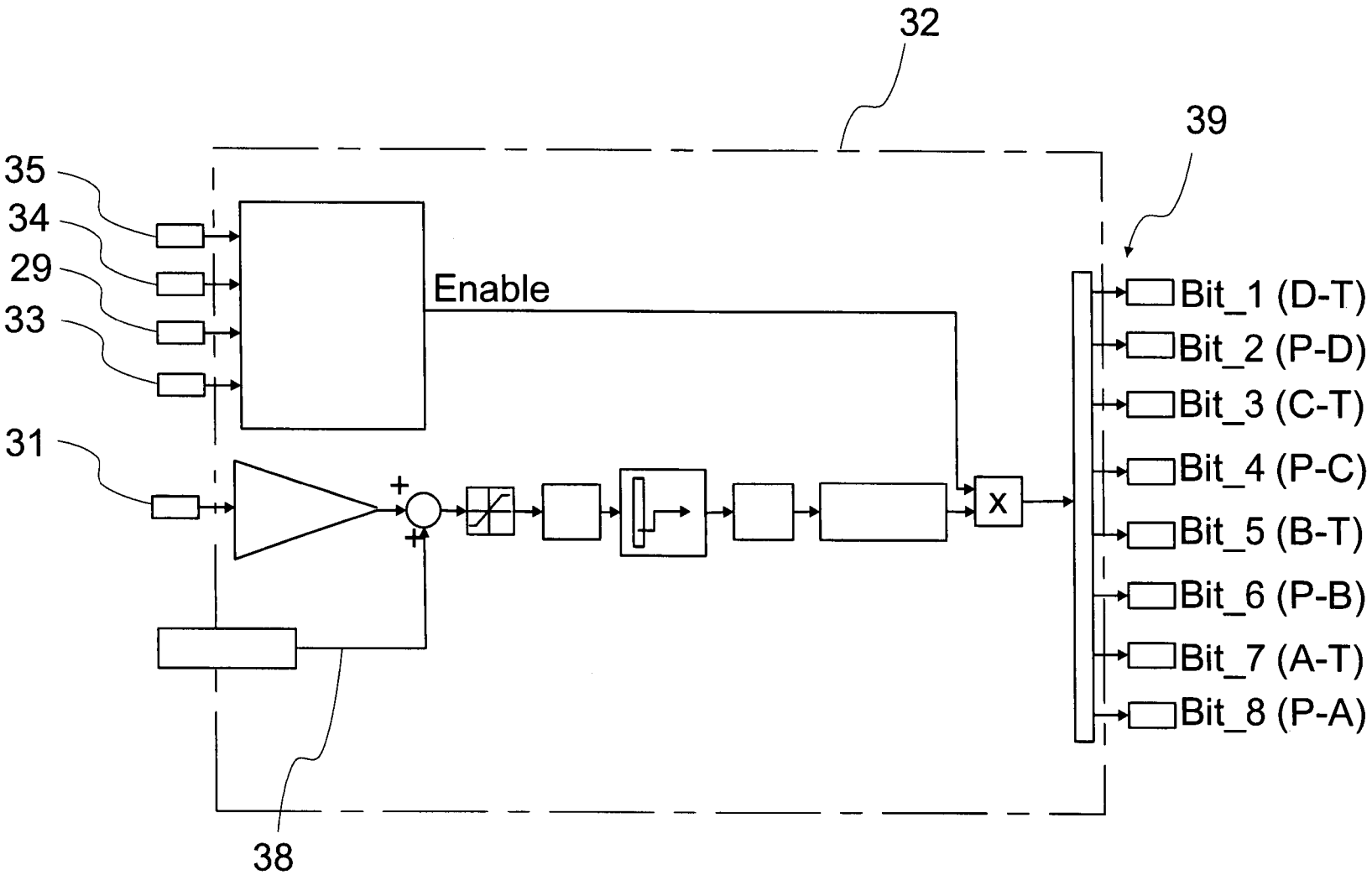
FIG. 8 shows the operation of a control converter for use in the control of the system.

The operation of the control converter of the controller is illustrated on the level of a schematic diagram in FIG. 8, and reference is simultaneously made to the state table of FIG. 2, which is utilized in the converter. On the basis of a given control value 31, the control converter 32 calculates the binary states 38 suitable for the control interfaces. The control value 31 is subjected to the necessary scalings, level conversions, and operations rounding to an integer, because discrete force levels are in question. If the integrating control (blocks 61 and 30) is not applied in the controller, an estimate 38 for the acceleration zero point or a variable proportional to this is also added to the control value 31 in the control converter 32.

The relative force control value 31 of the actuator must be scaled to the range of indices for the control of the state table of the actuator (FIG. 2, u %) in such a way that in all loading situations, a control value of zero (0) will generate a control value of the acceleration zero point to the input of the saturation block. This is implemented, in the present example, by multiplying the relative force control value with the magnitude of the indexing range for the controls, after which an estimate 38 for the acceleration zero point is added to the signal. The result is saturated into the indexing range from 0 to 15 and rounded to the closest integer, wherein the discrete control value u % has been formed.

After this, an ND (analog to digital) conversion is made in such a way that a decimal number corresponding to the binary number formed of the binary states of the control interfaces is retrieved from the table (0 . . . 255) at the discrete control value u % corresponding to this. The decimal value retrieved from the table is converted to a binary number, and the bits of said binary number are separated into their own outputs, according to the state table. Thus, binary controls 39 (open, closed) have been formed for each valve. In a locking situation, the control of each control interface is set in a state corresponding to closing.

Management and Optimization of Energy Consumption in an Actuator

We shall next discuss the changes in the states of the working chambers in the system. When the pressure of a working chamber increases from the LP pressure to the HP pressure, the pressurized medium in the working chamber is also compressed and the structures of the system yield to some extent, so that energy must be supplied from the HP circuit into the working chamber, if no precompression is performed by utilizing the system's own kinetic energy. When the pressure is decreased back to the LP pressure, said energy bound into the compressed pressurized medium is wasted, if one does not want to or cannot bind the energy to kinetic energy to be utilized in the system by means of expansion of the pressurized medium (pre-expansion). The larger the working chamber in which state changes take place, the larger the volume of the pressurized medium and the greater the amount of energy consumed or released in the state changes. Naturally, the number of state changes will also directly affect the energy consumption.

When examining the state table of FIG. 2, it can be seen that when the different control values u % are changed, a different number of working chamber specific state changes take place. With the control values u %=4 and u %=5, only the state of the smallest working chamber (O-chamber) changes, whereas with the control values u %=7 and u %=8, the states of all the working chambers change. As a result, a state change between the u %=4 and u5=% consumes many times less energy than a state change between the control values u %=7 and u %=8.

In view of the energy consumption, it is disadvantageous to perform the state changes of the control interface connected to the LP circuit and the control interface connected to the HP circuit of the same working chamber always at the same time, because in this case one of the control interfaces starts to close at the same time when the other control interface starts to open. Thus, for example, when the closing members of the control valves move simultaneously, both of the control interfaces are half open and thus pass momentarily a considerable quantity of volume flow (so-called short-circuit flow), which consumes energy. In the present description, this phenomenon is called a burst state change, due to the power loss of a short duration.

Power losses can be reduced by increasing the operating speeds of the control valves and by taking them into account in the control of the system.

When the working chamber is contracting and its pressure should be raised from the LP pressure to the HP pressure, it is advantageous, in view of the energy consumption, to set an opening delay for the control interface connected to the HP circuit. Thus, when the control interface connected to the LP circuit is closed, the working chamber is closed for some time. When the working chamber is contracted further, the pressure in the working chamber increases (pre-compression), and the control interlace connected to the HP circuit can be opened without an unnecessary power loss at the moment when the pressure in the working chamber has risen to the level of the HP pressure. A corresponding benefit can be achieved when the working chamber expands and its pressure should be changed from the HP pressure to the LP pressure. Thus, an opening delay is set for the control interface connected to the LP circuit; in other words, the state change of the working chamber is performed by closing the working chamber for a moment and by waiting, when the working chamber expands, that the pressure in the working chamber decreases to the level of the LP pressure (pre-expansion). Thus, the control interface connected to the LP circuit can be opened without power losses. In other state changes, it is difficult to avoid a power loss, and no opening delay is used in them.

The opening delays are controlled in the controller 24 of FIG. 5 and, for example, in its delay block 36, as presented above.

In one example, to minimize power losses in the state changes of the working chambers, it is possible to utilize, in connection with state changes, a pressure level that is set, for example, between the pressures of the HP and LP circuits, approximately to the half-way between them. As shown in FIG. 11, it is a charging circuit 121, in other words, an MP circuit. Preferably, at least one energy charging unit, for example, pressure accumulator, is connected to the MP circuit.

In a system comprising three or more pressure levels, it is possible to carry out an almost lossless state change between two pressure levels of the working chamber by utilizing the pressure level left between them. We shall discuss the state change of a working chamber of a single digital hydraulic actuator. At the beginning of the state change, the working chamber is under the LP pressure. At the beginning, the MP circuit is connected to the working chamber, wherein the pressure starts to increase in the working chamber. When the pressure level is sufficiently close to the HP pressure or it achieves its maximum otherwise, the HIP circuit is connected to the working chamber, wherein the pressure transient remains small and hardly any pressure overflow occurs. At any stage, there is no need to throttle the pressurized medium flows, resulting in an almost lossless state change. The energy needed for the state change is bound first from the working chamber or charging circuit by means of a parasitic inductance of the pipeline to kinetic energy of the charging circuit and thereby further to pressure energy of the working chamber.

The state change from the HP pressure to the LP pressure of the working chamber is also implemented in a corresponding way. At first, the MP circuit is connected to the working chamber, and when the pressure deficit is at its highest, the working chamber is connected to the LP pressure. Energy is bound and released in the state changes as already presented.

The Control and Optimization of the Pressure Levels of the Charging Circuits

We shall next discuss the effect of the HP and LP pressures on the gradation and force level and thereby the adjustability of the sum forces generated by the actuator.

If the LP pressure is very low, both the maximal propulsive force (positive sum force) and the maximal tractive force (negative sum force) increase as the HP pressure increases. Thus, the extent of the force range increases, wherein also the difference between the force levels increases, because the number of force levels remains unchanged. It is appropriate to use a very high ratio between the HP and LP pressures in applications, in which the magnitude and direction of the required sum force varies to a great extent. After the HP pressure has been set to a given level and the LP pressure is increased, the positive sum force to be achieved with the highest discrete control is reduced and the negative sum force to be achieved with the lowest discrete control shifts in the positive direction, wherein the force range of the actuator becomes narrower. When the LP pressure is increased sufficiently, the sum force to be achieved with the lowest discrete control shifts from negative to positive and thereby approaches further the positive sum force to be achieved with the maximal discrete control. When the force range becomes narrower, the difference between the force levels also becomes narrower, wherein the changes in the acceleration of the actuator are simultaneously reduced. This will improve the adjustability, if the application is such that the load force does not vary to a significant extent; that is, it always remains within certain tolerance values. Thus, in certain applications, it is appropriate that the LP and HP pressures are adjusted actively, if necessary, so that the force range covers the force production required for moving the load in an optimal way. The above-presented method reduces the energy consumption, because the power losses of burst state changes are the smaller, the closer the HP and LP pressures are to each other. Furthermore, the differences in the force levels are thus smaller, the adjustment is more accurate, the optimization is easier, and the energy efficiency is improved.

If the system does not comprise alternative storage units for the pressurized medium, the quantity of the pressurized medium contained in the pressure accumulators limits the maximum pressure of the HP circuit. On the other hand, the minimum pressure of the LP circuit is determined by the throughput capacity of the control valves, which is proportional to the pressure difference, together with the speed requirements of the actuator, wherein the HP and LP pressures cannot be adjusted in a way irrespective of each other. The adjustment of the HP and LP pressures irrespective of each other will require the inclusion of an alternative storage unit for pressurized medium in the system. The storage unit may be, for example, a pressure accumulator or a pressurized medium tank.

Optimization of the Controller

We shall next discuss the estimation of the term for compensation of the load force.

In the adjustment of the position, the speed, as well as the acceleration, to take into account the load force it is possible to use, for example, integrating adjustment, which is possible solely on the basis of the measured position data 27 and the speed data 29 which has been measured or integrated from the position data. Alternatively, it is also possible, however, to apply estimation of the so-called acceleration zero point in such a way that on the basis of the acceleration data obtained from an acceleration sensor fixed to the moving part of the system and data obtained on the force production of the actuator, a term for compensation of the load force, that is, an acceleration zero point estimate 38, is added to the control value 31. The data on the force production of the actuator can be calculated either directly from the discrete control of the actuator or on the basis of the measured pressures of the working chambers, or on the basis of data obtained directly from a force sensor.

By utilizing the system shown in FIG. 1, the estimation is based on a force equation of the continuity state of the system, in which the acceleration is zero, $$\Sigma F = m \cdot a, \text{ in which } a = 0, \text{ and}$$

$$\Sigma F = F_{cyl} + F_{load} = 0,$$

in which the forces effective in the direction that increases the length of the actuator by the piston of the actuator are positive, and the forces effective in the direction that decreases the length of the actuator are negative.

$$F_{cyl} = -F_{load}, \text{ in which}$$

$$F_{cyl} = \frac{\pi D_1^2 \cdot ((p_{HP} - p_{LP}) \cdot u\% + 10 p_{LP} - 5 p_{HP})}{36}.$$

As it is now assumed that the acceleration is zero, the control u % of the actuator that has been rounded to integers, that is, having a discrete value, has to be such that when a static or dynamic load force is effective, the absolute value of the realized acceleration is as close to zero as possible at each moment of time. The control of the actuator has a limited number of discrete states, wherein the zero acceleration is not often achieved at any of said states, but a theoretical control with a continuous value must be imagined between the discrete values, to be able to calculate an accurate value for the required control. This theoretical control with a continuous value, giving zero acceleration, is called the acceleration zero point $u_{a0}$ in this document. Said control is substituted for the discrete control of the actuator in the equation:

$$\frac{\pi D_1^2 \cdot ((p_{HP} - p_{LP}) \cdot u_{a0}(t) + 10 p_{LP} - 5 p_{HP})}{36} = -F_{load}(t)$$

if real-time sensor data or estimation data are obtained on the load force, the LP pressure and the HP pressure, said term $u_{a0}$ can be solved from the force equation in real time:

$$u_{a0} = \frac{5 p_{HP} - 10 p_{LP} - \frac{36}{\pi D_1^2} \cdot F_{load}}{(p_{HP} - p_{LP})}$$

The term $u_{a0}$ represents such an equivalent of the graded control value u % having a continuous value, or being unrounded, that produces in the best way the approximate zero acceleration when added to the control scaled to the zero-value indexing range of the controls of the actuator before the rounding operation. Thus, the discrete control u % of the actuator shifts exactly by the required shift so that the required compensation effect becomes true.

In the above-mentioned equations, the term $D_1$ is the diameter of the working chamber 19 (the largest A-chamber), $p_{HP}$ is the pressure of the HP circuit, $p_{LP}$ is the pressure of the LP circuit, and $F_{load}$ is the magnitude of the load force reduced for the actuator. The term $u_{a0}$ varies between 0 and 15 in this example. The left side of the force equation represents the force $F_{cyl}$ produced by the actuator. Dependent on the selected step of the control value $u_{a0}$ (see FIG. 2) is also the force produced by the system, which must be equal to the load force at the acceleration zero point.

The total force effective on the system is calculated by multiplying the acceleration obtained, for example, in the form of sensor data, with the inertial mass reduced for the actuator. The assumed force $F_{cyl}$ generated by the actuator can be calculated directly on the basis of the discrete control of the actuator, but a more reliable result of the force production in all situation is obtained by calculating the force on the basis of the measured pressures and effective areas of the working chambers, or directly as a measurement result from a force sensor. The load force $F_{load}$ is now obtained as the difference between said total force and the force generated by the actuator. The value of the load force obtained as a calculation result can now be inserted, together with the HP and LP pressures, in the equation of the acceleration zero point, wherein the equation gives the value of the acceleration zero point as a result. Alternatively, the load force $F_{load}$ can also be inserted in a table that corresponds to the force curve of the actuator and that is stored in the control converter 32 in the same way as the state tables of FIG. 2. By the load force in the table is also found the control value needed for generating a counter-force equal to the load force. The method based on tabulation is functional particularly when the dimensioning of the effective areas deviates, for example, from the binary series in such a way that the force levels are graded unevenly.

The calculated or tabulated control value (estimate 38) is added to the control value 31 of the actuator, for example, in the control converter 32, after which the control converter calculates the controls 39 of the control interfaces. Compensation of the load force takes place, for example, in a separate control block or in a compensation block 48, as shown in FIG. 5. The inputs of the compensation block 48 are the pressures of the HP and LP circuits, the pressures of the working chambers, as well as the acceleration of the moving part of the actuator. Furthermore, if the frictions and end forces of the actuators are included in the module for estimating the force produced by the actuator, the position and the speed of the actuator are also needed as inputs. The inputs of the controller are obtained, for example, from suitable sensors placed in the system. The estimate for the acceleration zero point, obtained as the output from the compensation block 48, is input in the control converter 32.

Control and Optimization of Failures in the Control Interface

We shall next discuss a system and a method to be applied in the presented system, and particularly its controller. Due to a defective valve, the operation of the control interface is disturbed, which must be taken into account in the operation of the controller used for controlling the system.

The principles of the above-mentioned method can be applied in a system comprising two or more pressure levels, in the case of controlling an actuator comprising one or more working chambers by means of a control circuit in which one or more valves of the control interface remain permanently closed or open in a failure situation. In the example situation, we shall discuss a four-chamber cylinder actuator in a dual-pressure system.

When the valves remain permanently closed, one must make sure that the working chamber of the actuator does not remain the closed state except for during locking of the actuator or during pre-compression or pre-expansion of the working chamber. Furthermore, in a situation of jamming, the maximum speed of the actuator is limited to prevent cavitation of the working chambers connected to the HP and LP circuits or overpressure of the working chambers during movements of the piston. The closed position of the working chamber means that all the control interfaces relating to said working chamber are closed.

When the valves remain permanently open, one must make sure that the controls in the control vector of the controller are in the order that the sum forces generated by means of them are in an order of magnitude. Furthermore, one must make sure that during locking, the holding force of the actuator is sufficient; in other words, that the actuator cannot "creep" against its chamber pressure limits. This is possible by leaving the working chamber, in which valves of the control interface have been jammed open, unlocked.

We shall now discuss fault management when the control interface or its valves are left open (on position) or closed (off position), excluding locking situations, in which the control interface has been left open due to a valve failure.

We shall first look at a single working chamber of an actuator. FIG. 1 shows an example of a single working chamber 19 (A-chamber) of a digital hydraulic actuator, and the control interfaces 9 (HP-A) and 10 (LP-A) controlling the same. When the control interface HP-A is controlled to be completely open and the control interface LP-A is controlled to be completely closed, the pressure of the HP line 3 is effective in the chamber 19. In a corresponding manner, when the control interface HP-A is controlled to be completely closed and the control interface LP-A is controlled to be completely open, the pressure of the LP line 4 is effective in the chamber 19. The pressures are changed in the above-presented manner in a normal operating state, significantly irrespective of the speed of change in the volume of the working chamber 19, because the maximum throughput capacities of the control interfaces are dimensioned to be large in relation to the volume of the working chamber.

If only one valve is available for each control interface and the valve of any control interface is jammed in the closed position, the whole control interface will be jammed in the closed position accordingly. Thus, when for example the control interface HP-A is jammed in the completely closed position, the control interface LP-A must be kept continuously open during the movement of the actuator, to prevent an excessive increase in the pressure, or cavitation, in the working chamber. Thus, those controls must be cut from the control vector of the controller, in which the A-chamber is controlled to the pressure of the HP line; in other words, those controls in which the state of the A-chamber is one (1). An example of the control vector is shown in FIG. 2, wherein reference is made to a single row or column. The control vector contains information on the different control combinations of the valves available, as well as the order of use between said control combinations. The order of use is determined in such a way that the sum forces generated by means of the control combinations are in the order of magnitude.

In a corresponding manner, when the control interface LP-A is jammed in the completely closed position, the control interface HP-A must be kept continuously open during the movement of the actuator. Thus, those controls must be cut from the control vector of the controller, in which the A-chamber is controlled to the pressure of the LP line; in other words, those controls in which the state of the working chamber A is zero (0).

If the control interface LP-A is jammed in the completely open position, the pressure of the LP line can be generated to the A-chamber by controlling the control interface HP-A to be closed. Alternatively, the control interface HP-A is controlled to be open, wherein a short-circuit flow of pressurized medium will flow through the control interfaces HP-A and LP-A directly from the HP line to the LP line. The pressure of the A-chamber will thus be set approximately half-way between the pressure of the HP line and the pressure of the LP line, which may also be called the intermediate pressure. Thus, the sum force generated by each control combination in the control vectors is recalculated on the basis of the effective areas and the pressures of the HP and LP lines, and it is simultaneously assumed that said intermediate pressure is effective in the A-chamber always when its state is one (1). The control vector is rearranged so that the corresponding generated sum forces are in the order of magnitude.

Alternatively, if the control interface HP-A is jammed in the completely open position, it is possible to generate, in the A-chamber, either the pressure of the HP line by controlling the control interface LP-A to be closed, or said intermediate pressure by controlling the control interface LP-A to be open, wherein a corresponding short-circuit flow occurs again. In rearranging the control vector and in recalculating the generated sum forces, it is assumed that said intermediate pressure is effective in the A-chamber always when its state is zero (0).

If the control interface connected to the LP circuit, or its valve, is jammed in the closed position, this will only affect the capability of the working chamber connected to said control interface to achieve the pressure level of the LP circuit during the movement of the actuator. In a corresponding manner, if the control interface connected to the HP circuit, or its valve, is jammed in the closed position, this will only affect the capability of the working chamber connected to said control interface to achieve the pressure level of the HP circuit.

We shall next look at an example in which one or more control interfaces comprise two or more valves coupled in parallel, which together put through the desired total volume flow, depending on the throughput capacity of each valve. In each valve, the pressure loss is kept as small as possible. The valves are different or, for example, identical on/off valves. If any valve in any control interface is jammed in the closed position so that there are still functional valves left in said control interface, this fault in the static state of the actuator will have no significant effect on the force component generated by said working chamber and thereby neither on the sum force generated by the actuator. The static state refers to a state in which the actuator is not moving and the control of the actuator remains constant with respect to time, but the control of the actuator may still be any of the discrete controls of the actuator.

In the above-described situation, the pressure of the HP or LP line will be generated in the working chamber in the intended way. Now, however, the control interface, in which a valve is jammed in the closed position, is narrower than the other control interfaces, and its throughput capacity is reduced in comparison with the situation before the fault; in other words, the volume flow with the same pressure difference is reduced. Because of this, inertia may occur in the state changes of said working chamber compared with those of the other working chambers, which inertia should be taken into account. Because of the fault, the pressure level is also set more slowly to the desired value, and furthermore, when the working chamber expands, the pressure of the working chamber remains lower than normally below the target pressure level, and when the working chamber contracts, the pressure of the working chamber increases higher than normally above the target pressure level. The pressure deviation from the target pressure will depend on the speed of change in the volume of the working chamber and the proportion of the throughput capacity of the faulty valve in relation to the throughput capacity of the whole control interface. Because of this, the maximum speed of the actuator must be limited so that the deviations in the pressure of the working chamber occurring during the movement would not become so high that the sum forces generated by the controls would no longer be in the order of magnitude.

If the control interface connected to the LP circuit is jammed in the open position, this will not affect the capability of the respective working chamber to achieve the pressure level of the LP circuit. In a corresponding manner, if the control interface connected to the HP circuit is jammed in the open position, this will not affect the capability of the working chamber to achieve the pressure level of the HP circuit.

If any valve of the control interface is jammed in the open position and the control interface should be closed, this will have a clear effect on the force component generated by the working chamber and the sum force generated by the actuator. If the working chamber should have the pressure of the LP circuit and, for example, one valve of the control interface HP-A is jammed in the open position, a short-circuit flow will occur between the control interfaces HP-A and LP-A from the HP line to the LP line. Thus, the intermediate pressure remaining in the working chamber is clearly higher than the pressure of the LP circuit. In a corresponding manner, when the working chamber should have the pressure of the HP circuit and, for example, one valve of the control interface LP-A is jammed in the closed position, an intermediate pressure that is clearly lower than the HP pressure will remain in the working chamber.

In the static state of the actuator, the pressure of the working chamber will follow the equation:

$$p_{kammio} = p_{HP} - \frac{p_{HP} - p_{LP}}{1 + \left(\frac{A_{HP}}{A_{LP}}\right)^2},$$

in which:

$A_{HP}$=the sum of the throughput areas of the open valves in the control interface of the HP line $A_{LP}$=the sum of the throughput areas of the open valves in the control interface of the LP line The throughput capacity of a valve is proportional to its throughput area. In the case of a four-chamber actuator, it has been found by calculations that the deviation of the intermediate pressure from the target pressure (HP/LP) is relatively small, if less than ⅓ of the sum of the throughput areas of the valves of the control interface are jammed in either the open or closed position. Thus, the order of magnitude of the sum forces generated by the actuator will not change in the static state, wherein the order of the controls in the control vector of the controller does not need to be changed, and in the case of a failure, it is possible to use the original control vector.

Above, it has been assumed that only one valve becomes faulty at a time, because the simultaneous failure of several valves is very unlikely. When several valves fail at the same time, an attempt is made to lock the actuator and the mechanism controlled by it in position, if possible. Furthermore, it has been assumed that the realized positions of the valves can be verified, for example, by means of sensors and that it is possible to compare whether the realized position corresponds to the position according to a control value given by a controller. The position will depend on the state of the valve. On the basis of the comparison, it is possible to conclude which valve is faulty and in which position it has been jammed. On the basis of this, it is possible to perform the necessary changes in the controller to compensate for the failure and to use the controller to control the valves which are still in working order.

In the following, we will present the operation of the algorithm relating to a failure by means of an example. The same principles also apply in the case of an actuator in which the number of chambers is other than four and/or several pressure levels are available for each working chamber. In the control interfaces, variable numbers of valves may be applied, and the relative throughput capacities of the valves may vary.

In this example, the above-presented four-chamber cylinder actuator is used in the presented digital hydraulic dual-pressure system. Both control interfaces of each working chamber comprise, for example, two valves with different throughput capacities. Within the control interface, any relative division may be applied between the valve throughput capacities or throughput areas, for example 1:1 or 20:1. Consequently, there are a total of 16 valves in the control interfaces, and the states and positions of the valves controlling the actuator can be given unambiguously with a 16-number or 16-bit binary number, for example in the order HP-A, LP-A, HP-B, LP-B, HP-C, LP-C, HP-D, LP-D, wherein the binary number becomes 00 00 00 00 00 00 00 00 or 11 11 11 11 11 11 11 11 and all the binary numbers between these.

It is reasonable to arrange the significance between the bits of the binary number in such a way that the significance is proportional to the size of the working chamber corresponding to each control interface; in other words, the bits denoting to the control interfaces of the working chamber with the largest effective area have the greatest significance. The same applies to the valves of the same control interface, wherein the throughput capacity is taken into account. The significance between the bits of the control interfaces of the HP and LP lines connected to the same working chamber is a question of agreement.

If all the valves follow their respective control values (open/closed, on/off, 1/0) within the set response times, the actual value after a delay of the response time can be made to correspond to the control value. Consequently, the difference between the binary numbers corresponding to the actual value and the control value is thus zero.

When any actual value of the control interface, that is, the valve state, deviates from the control value sufficiently clearly, it can be stated that there is a failure situation. The faulty valve and the type of failure (jamming in the open or closed position) can be concluded from the value of the difference between the binary numbers corresponding to the control value and the actual value, because the significance of the bit controlling the valve determines the magnitude of said difference. In a 16-bit system, the least significant bit, that is, the smallest valve of the control interface LP-D, gives, in a failure situation, a difference +/−1 (+/−$2^0$), depending on the type of failure. In a corresponding manner, the most significant bit will give the difference +/−32768 (+/−$2^{15}$), depending on the type of failure.

When the bits of the binary number represent the control interface sequence HP-A, LP-A, HP-B, LP-B, HP-C, LP-C, HP-D, LP-D, and the difference between the control value and the actual value is, for example, +8192 ($2^{13}$), it can be found that the largest valve of the control interface LP-A is jammed in the open position. From the index of the difference, it can be concluded that it is the thirteenth bit in question, as the indexing starts from zero; in other words, the fourteenth bit of the binary number, counting from the right, and the more significant bit of the control interface LP-A. From the sign of the difference it can be concluded that the valve is jammed in the open position, because the binary number of the actual value of the valves, from which the binary number of the guideline value is subtracted, is greater than the binary number of the guideline value.

Now, it is known that the ratio of the valves of the control interface LP-A is, for example, 20:1 and the larger valve is jammed in the open position. Furthermore, it is known that the throughput capacities of the control interface HP-A are, in the normal state, for example identical with the control interface LP-A, so that the maximum throughput capacity of the control interface HP-A can be represented by the index 21 (20+1). Thus, the pressure of the LP circuit is always generated in the working chamber when the state of the working chamber is the 0 state, but when the state of the working chamber is changed to the 1 state, the working chamber will not achieve the pressure of the HP circuit and the intermediate pressure will remain in the working chamber, because there is a jammed valve in the control interface LP-A.

Said intermediate pressure in the static state of the actuator can be calculated from the above-presented equation, in which the ratio $A_{HP}/A_{LP}$ now corresponds to the ratio 21/20. By utilizing the intermediate pressure, it is possible to calculate all the force components and sum forces to be generated for all the failure situations in which a valve is jammed in the open position.

Table B shows the states of the working chambers of the actuators and the magnitude of the sum force (No_err) in the case that there are no failures in the system. From the recalculated sum force (LP-A open), it is seen that in the static state, the sum forces are no longer in an order of magnitude, and therefore, the control vector describing the controls (dec(0 . . . 15)) must be rearranged as shown in Table C, so that the sum forces were in the order of magnitude, which can be utilized by the controller.

TABLE B

| u | dec (0 . . . | Kammioiden binääriset ohjaukset | | | | | |
|---|---|---|---|---|---|---|---|
| % | 15) | A | B | C | D | No_err | LP-A open |
| 0 | 5 | 0 | 1 | 0 | 1 | −38.46 | −38.45859 |
| 1 | 4 | 0 | 1 | 0 | 0 | −30.13 | −30.12709 |
| 2 | 7 | 0 | 1 | 1 | 1 | −22.12 | −22.12231 |
| 3 | 6 | 0 | 1 | 1 | 0 | −13.79 | −13.79081 |
| 4 | 1 | 0 | 0 | 0 | 1 | −5.21 | −5.214258 |
| 5 | 0 | 0 | 0 | 0 | 0 | 3.12 | 3.117245 |
| 6 | 3 | 0 | 0 | 1 | 1 | 11.12 | 11.12202 |

TABLE B-continued

| u | dec (0 . . . | Kammioiden binääriset ohjaukset | | | | | |
|---|---|---|---|---|---|---|---|
| % | 15) | A | B | C | D | No_err | LP-A open |
| 7 | 2 | 0 | 0 | 1 | 0 | 19.45 | 19.45353 |
| 8 | 13 | 1 | 1 | 0 | 1 | 27.31 | −3.97368 |
| 9 | 12 | 1 | 1 | 0 | 0 | 35.64 | 4.357824 |
| 10 | 15 | 1 | 1 | 1 | 1 | 43.641 | 2.3626 |
| 11 | 14 | 1 | 1 | 1 | 0 | 51.97 | 20.69411 |
| 12 | 9 | 1 | 0 | 0 | 1 | 60.55 | 29.27065 |
| 13 | 8 | 1 | 0 | 0 | 0 | 68.88 | 37.60216 |
| 14 | 11 | 1 | 0 | 1 | 1 | 76.89 | 45.60694 |
| 15 | 10 | 1 | 0 | 1 | 0 | 85.22 | 53.93844 |

TABLE C

| u | dec (0 . . . | Kammioiden binääriset ohjaukset | | | | | |
|---|---|---|---|---|---|---|---|
| % | 15) | A | B | C | D | No_err | LP-A open |
| 0 | 5 | 0 | 1 | 0 | 1 | −38.46 | −38.45859 |
| 1 | 4 | 0 | 1 | 0 | 0 | −30.13 | −30.12709 |
| 2 | 7 | 0 | 1 | 1 | 1 | −22.12 | −22.12231 |
| 3 | 6 | 0 | 1 | 1 | 0 | −13.79 | −13.79081 |
| 4 | 1 | 0 | 0 | 0 | 1 | −5.21 | −5.214258 |
| 5 | 13 | 1 | 1 | 0 | 1 | 27.31 | −3.97368 |
| 6 | 0 | 0 | 0 | 0 | 0 | 3.12 | 3.117245 |
| 7 | 12 | 1 | 1 | 0 | 0 | 35.64 | 4.357824 |
| 8 | 3 | 0 | 0 | 1 | 1 | 11.12 | 11.12202 |
| 9 | 15 | 1 | 1 | 1 | 1 | 43.641 | 2.3626 |
| 10 | 2 | 0 | 0 | 1 | 0 | 19.45 | 19.45353 |
| 11 | 14 | 1 | 1 | 1 | 0 | 51.97 | 20.69411 |
| 12 | 9 | 1 | 0 | 0 | 1 | 60.55 | 29.27065 |
| 13 | 8 | 1 | 0 | 0 | 0 | 68.88 | 37.60216 |
| 14 | 11 | 1 | 0 | 1 | 1 | 76.89 | 45.60694 |
| 15 | 10 | 1 | 0 | 1 | 0 | 85.22 | 53.93844 |

The above-presented algorithm can also be applied when several charging circuits with different pressure levels can be coupled to a single working chamber. Thus, such controls are cut, in which the actual states of the control interfaces do not, because of faulty valves, correspond to the desired states, particularly if the fault has a significant effect on the sum force generated by the actuator with said control.

Applying the Digital Hydraulic Actuator

We shall now discuss the uses of the digital hydraulic actuator in a digital hydraulic system. The actuator is particularly a digital cylinder, and its applications include various pump, motor, energy charging, pressure converter, energy converter, slewing drive, and rotating drive applications.

Figure 14:
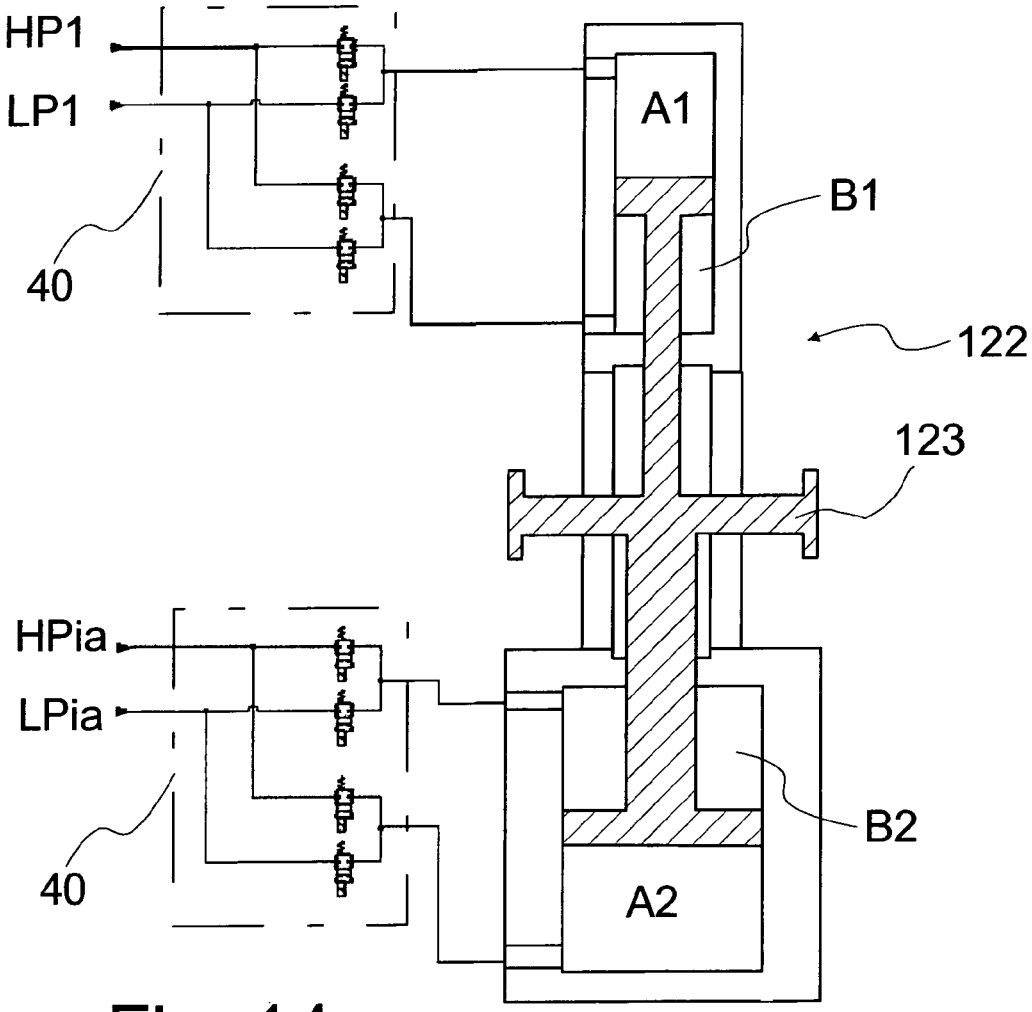
FIG. 14 shows a pump pressure converter according to an example, comprising four chambers.
Figure 15:
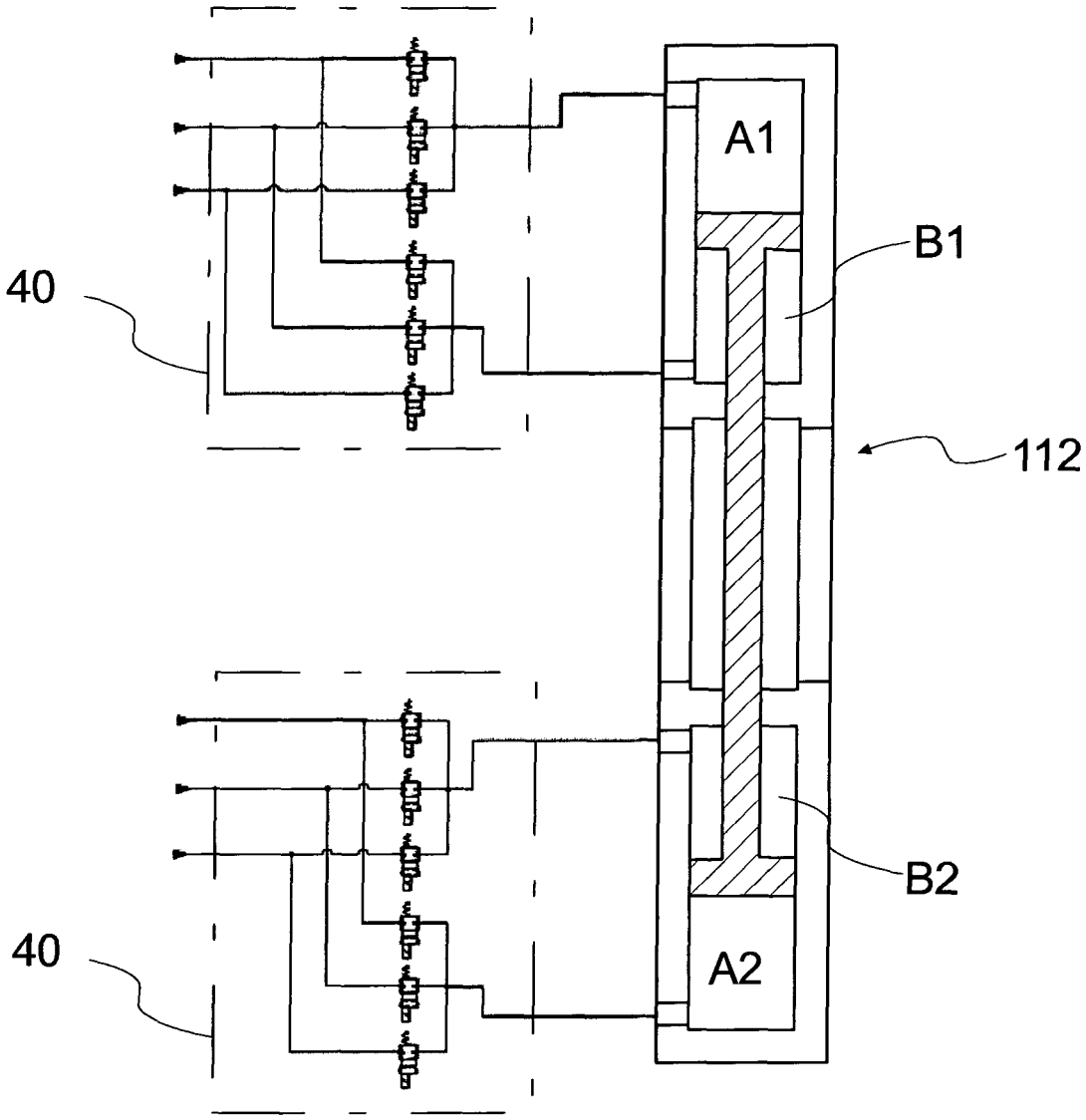
FIG. 15 shows a pressure converter according to an example, comprising four chambers.
Figure 16:
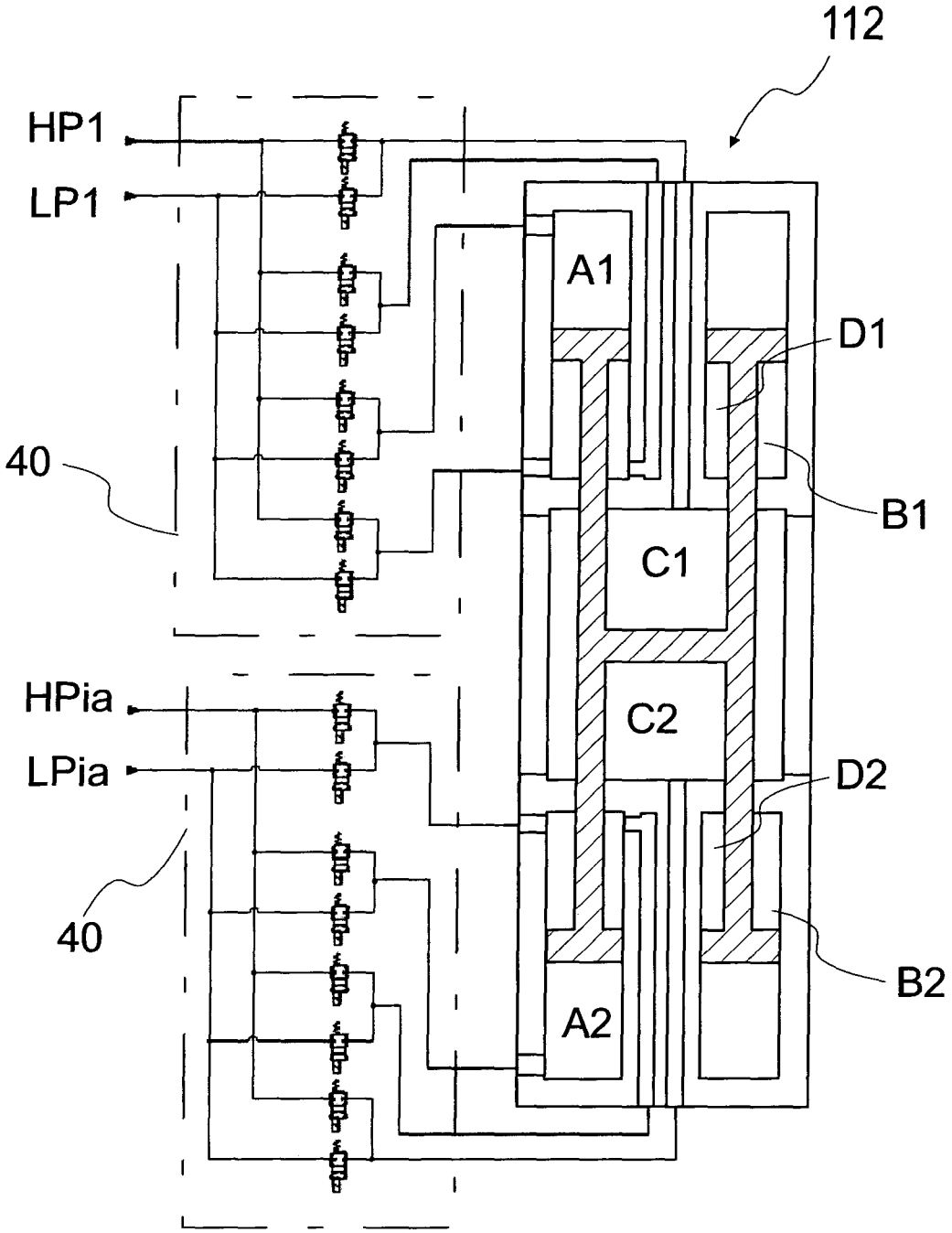
FIG. 16 shows a pressure converter according to an example, comprising four chambers and being controlled by control circuits.
Figure 17:
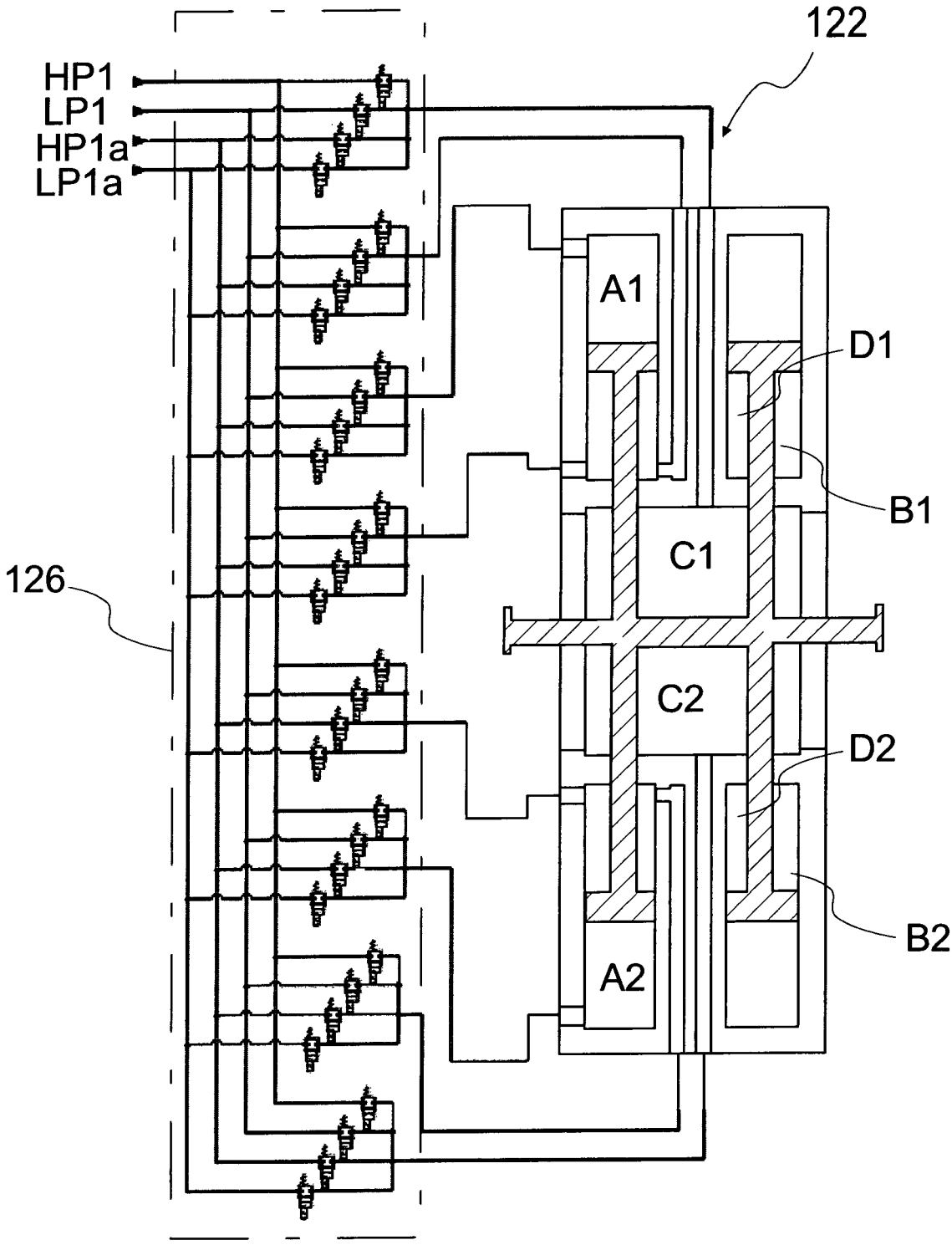
FIG. 17 shows a pump pressure converter according to an example, comprising eight chambers and being controlled by a crossed connection.

The example of FIG. 1 comprises a digital cylinder whose operation has already been discussed above. The example of FIG. 9 of the slewing drive comprises a stewing device converting a linear motion to a rotary motion, in which the above-presented system is applied. In the construction and mountings of the slewing device, it is possible to use corresponding members of slewing devices known as such. The example of FIG. 10 on a rotating drive comprises a digital hydraulic pump motor, in which several cylinder actuators are applied and which can be applied as a digital hydraulic motor and as a pump in a digital hydraulic system. The example of FIG. 11 comprises a digital hydraulic pressure converter 112 (DPCU), in which several digital cylinders are applied, and other examples are shown in FIGS. 15 and 16. The example of FIG. 12 comprises a digital hydraulic pump pressure converter 122 (DPCPU), in which several digital cylinders are applied and which is connected by means of a moving part 123 to a source of external energy, and other examples are shown in FIGS. 14 and 17.

Digital Hydraulic Slewing Device

Figure 9:
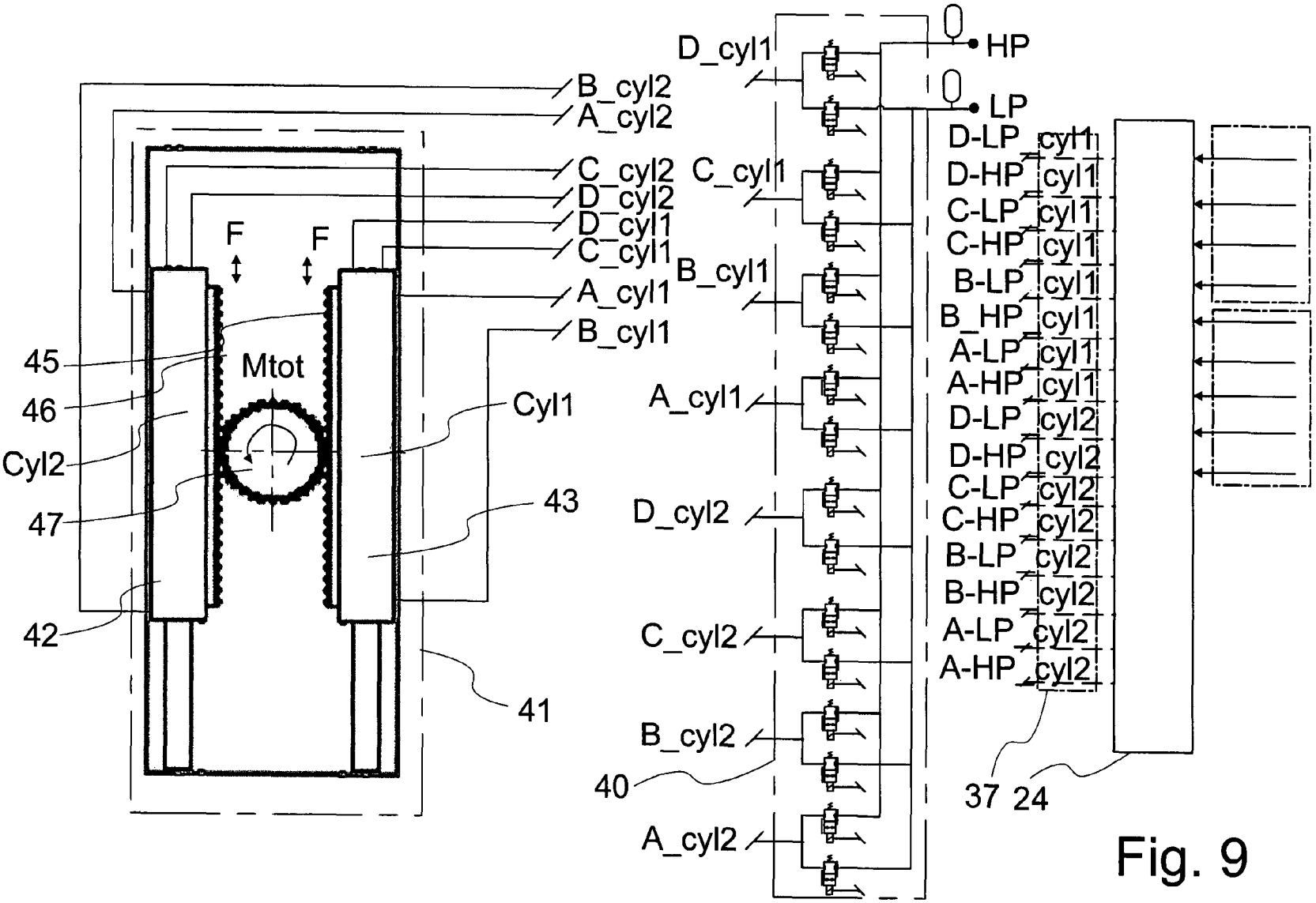
FIG. 9 shows a slewing device according to an example of the invention.

In the example of FIG. 9, a slewing device 41 comprises, for example, gear racks 45 and 46 which rotate a slewing gear wheel 47. The slewing device is mounted, for example, on the frame of a movable working machine, and the slewing gear wheel is used for rotating the cabin or crane of a working machine. Typically, the slewing device comprises means which convert a linear motion to a rotary motion. The linear motion is implemented by means of a cylinder, and the rotary motion by means of a rotating shaft.

The moment-controlled slewing device is typically implemented with two actuators 42 and 43 which are coupled in parallel, each actuator on its own gear rack 45 or 46 in such a way that the piston rods of the actuators point in the same direction, wherein when one actuator becomes longer, the other becomes shorter. The gear racks are mounted in parallel by the side of the actuators to drive the slewing gear wheel 47 on two sides. In this case, the frames of the actuator are moving, and the piston rod is mounted in a stationary manner on the slewing device and thereby, for example, on the frame of a working machine. The maximum total force of the actuators effected by them on the slewing gear wheel 47 is, in this case, the sum of the maximum tractive total force of one actuator and the maximum propulsive total force of the other actuator. The total moment Mtot of the slewing device in each direction of rotation is thus in its maximum and is formed as a sum of the maximum total force of each actuator and the calculated products of the radius R of the slewing gear wheel 47

The slewing device 41 is controlled by a control circuit, in which a control interface is provided for each working chamber of the actuator of the stewing device, by means of which control interface said working chamber can be connected either to the low pressure LP or the high pressure HP. The control circuit corresponds, in its functionality, to the control circuit 40 of FIG. 1, and it implements the necessary connections for the pressurized medium.

The number of the states of the stewing device depends on the structure of the actuators 45, 46. Several alternatives are available for providing the control of the actuators. In the case of several actuators, the number of the states of the slewing device 41 is formed as a power function $a^b$ so that the base number a is the number of states of the controls of the actuator, for example $a=2^n$, in which n is the number of working chambers, and the index b is the number of actuators. In the case of two actuators with two working chambers each, the number of states is 16, and in the case of two actuators with four working chambers each, the number of states is 256. Each state corresponds to a moment value Mtot. Each actuator is controlled with a control circuit according to FIG. 1. If the actuators 45, 46 are equal or they have working chambers of equal effective areas, the total number of different states will remain smaller because of redundant states, and the same total moment Mtot will be achieved in two or more states. In the example of FIG. 9, the actuators are identical and each comprises four working chambers in the same way as the actuator 23 of FIG. 1, wherein each actuator can be used to produce 16 different forces by utilizing an equal grading. Thus, the total number of states is 31, when the redundant states are omitted from the calculations. The number of states is smaller by one state than the total number of states of two actuators, because the state producing the zero moment is common to both actuators. The slewing device has at least one state that produces a zero moment when the total forces of the actuators overcome each other, as well as a 15-step moment adjustment in one direction of rotation and a 15-step moment adjustment in the opposite direction of rotation. The effective areas of the working chambers of the actuators are encoded preferably by binary weighting coefficients, to provide an evenly graded moment control. In addition, the cylinders are preferably identical.

The states selected to produce a zero moment can be any state of the actuators, for example the states of positive or negative extreme forces, or any state therebetween, for example from the mid range. When the actuators are equal in dimensions, the stewing device produces a zero moment each time when the controls of the actuators are equal to each other. In other words, the initial tension produced by the zero control can be produced in any states of the actuator (in the case of actuators with four chambers, by force levels 0 to 15). Thus, the moment steps can also be created in many ways, for example in such a way that one actuator works in a saturated range and the other in its linear range when the moment adjustment is made in one direction of rotation, and in a corresponding manner reversely when the moment adjustment is made in the other first direction of rotation (see alternatives 1 and 2 in Table A).

TABLE A

| Järjestelmän | Vaihtoehto1 | | Vaihtoehto2 | | Vaihtoehto3 | | Vaihtoehto4, jne. | |
|---|---|---|---|---|---|---|---|---|
| ohjaus u % | Cyl1 ohjaus u1% | Cyl2 ohjaus u2% | Cyl1 ohjaus u1% | Cyl2 ohjaus u2% | Cyl1 ohjaus u1% | Cyl2 ohjaus u2% | Cyl1 ohjaus u1% | Cyl2 ohjaus u2% |
| 0 | 0 | 15 | 0 | 15 | 0 | 15 | 0 | 15 |
| 1 | 0 | 14 | 1 | 15 | 0 | 14 | 1 | 15 |
| 2 | 0 | 13 | 2 | 15 | 1 | 14 | 2 | 15 |
| 3 | 0 | 12 | 3 | 15 | 1 | 13 | 2 | 14 |
| 4 | 0 | 11 | 4 | 15 | 2 | 13 | 2 | 13 |
| 5 | 0 | 10 | 5 | 15 | 2 | 12 | 2 | 12 |
| 6 | 0 | 9 | 6 | 15 | 3 | 12 | 3 | 12 |
| 7 | 0 | 8 | 7 | 15 | 3 | 11 | 4 | 12 |
| 8 | 0 | 7 | 8 | 15 | 4 | 11 | 5 | 12 |
| 9 | 0 | 6 | 9 | 15 | 4 | 10 | 5 | 11 |
| 10 | 0 | 5 | 10 | 15 | 5 | 10 | 5 | 10 |
| 11 | 0 | 4 | 11 | 15 | 5 | 9 | 5 | 9 |
| 12 | 0 | 3 | 12 | 15 | 6 | 9 | 6 | 9 |
| 13 | 0 | 2 | 13 | 15 | 6 | 8 | 7 | 9 |
| 14 | 0 | 1 | 14 | 15 | 7 | 8 | 8 | 9 |
| 15 | 0 | 0 | 15 | 15 | 7 | 7 | 8 | 8 |
| 16 | 1 | 0 | 15 | 14 | 8 | 7 | 8 | 7 |
| 17 | 2 | 0 | 15 | 13 | 8 | 6 | 8 | 6 |
| 18 | 3 | 0 | 15 | 12 | 9 | 6 | 9 | 6 |
| 19 | 4 | 0 | 15 | 11 | 9 | 5 | 10 | 6 |

TABLE A-continued

| Järjestelmän | Vaihtoehto1 | | Vaihtoehto2 | | Vaihtoehto3 | | Vaihtoehto4, jne. | |
|---|---|---|---|---|---|---|---|---|
| ohjaus u % | Cyl1 ohjaus u1% | Cyl2 ohjaus u2% | Cyl1 ohjaus u1% | Cyl2 ohjaus u2% | Cyl1 ohjaus u1% | Cyl2 ohjaus u2% | Cyl1 ohjaus u1% | Cyl2 ohjaus u2% |
| 20 | 5 | 0 | 15 | 10 | 10 | 5 | 11 | 6 |
| 21 | 6 | 0 | 15 | 9 | 10 | 4 | 11 | 5 |
| 22 | 7 | 0 | 15 | 8 | 11 | 4 | 11 | 4 |
| 23 | 8 | 0 | 15 | 7 | 11 | 3 | 11 | 3 |
| 24 | 9 | 0 | 15 | 6 | 12 | 3 | 12 | 3 |
| 25 | 10 | 0 | 15 | 5 | 12 | 2 | 13 | 3 |
| 26 | 11 | 0 | 15 | 4 | 13 | 2 | 14 | 3 |
| 27 | 12 | 0 | 15 | 3 | 13 | 1 | 14 | 2 |
| 28 | 13 | 0 | 15 | 2 | 14 | 1 | 14 | 1 |
| 29 | 14 | 0 | 15 | 1 | 14 | 0 | 14 | 0 |
| 30 | 15 | 0 | 15 | 0 | 15 | 0 | 15 | 0 |

If the states that produce a zero moment are selected from the mid range of the states of the actuator, the moment steps can also be created by changing the states of the actuators in an alternating manner, so that both actuators can operate in their linear range within the whole moment range (see alternative 3 in Table A). Operating in the linear range of the actuators means that the unsaturated discrete control value of the actuator does not exceed the maximum value of the saturated discrete control value (u %) within the indexing range of the states of the actuators. Changing the state can also be done in turns of two or three steps (see alternative 4 in Table A) or by utilizing any other permutation algorithm, examples being given in the appended Table A.

Figure 7:
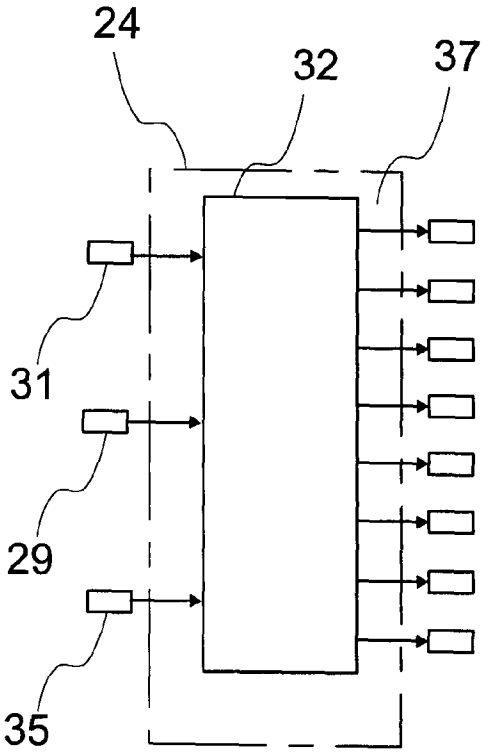
FIG. 7 shows another alternative controller for use in controlling the system.

For the control of the stewing device, it is possible to use the controller 24 shown in FIG. 5, 6 or 7, whose control converter 32 is expanded in such a way that it can be used to control a sufficient number of control interfaces which determine the states of the actuators. The table shown in FIG. 2 is expanded in such a way that the number of indices corresponds to various control values, and the values of columns are added to represent different states of the system, and the binary number indicating the binary states of the chambers is increased (in other words, the number of binary numbers indicating the binary controls of the actuators increases according to the number of actuators), and the columns representing the binary states of control interfaces increase because of an increase in the control interfaces. Furthermore, it is possible to utilize a set value 31 that is proportional to the moment to be generated and the direction of rotation of the slewing device. Because the moment to be generated is directly proportional to the sum force generated by the actuators (the coefficient being the radius R of the slewing gear wheel 47), it is still possible to use, for the control, the control value 31 of the effective force, described in connection with FIG. 5, which will be processed as presented in connection with FIG. 8. The acceleration-controlled system can be made speed-controlled as presented above.

The controller of the stewing device can also be implemented by means of two parallel controllers shown in FIG. 5, 6 or 7, wherein each controller controls a single actuator 42 or 43. This is possible, because the force effects generated by the actuators 45 and 56 are also separate. The relative control value 31 for the effective force (acceleration), the control value 28 for the speed, or the control value 26 for the position can be entered as inputs in both converters that will compute the positions corresponding to the desired acceleration for the control valves of each actuator according to the loading situation.

As described above, energy is consumed in connection with state changes. It is characteristic to the control of the actuators that it is between the control value corresponding to the acceleration zero point and the control values closest to this on each side where most state changes take place. As the initial tension of the cylinder actuators can be freely selected in this system of the slewing device, such a control value for the zero moment can be selected from the state table of the system, from which control value the closest state changes in both directions consume as little energy as possible. Such controls include, for example in the case of an actuator with four chambers, the control values 10 and 5. In the system of the slewing device, it is also possible to apply the above-presented precompression and preexpansion, particularly by means of delays controlled by the controller.

Digital Hydraulic Pump Motor and Rotating Device

We shall next discuss a digital hydraulic pump motor that can be applied both as a digital hydraulic pump and as a motor in a digital hydraulic system. The system described above can also be applied in the pump motor.

Figure 10:
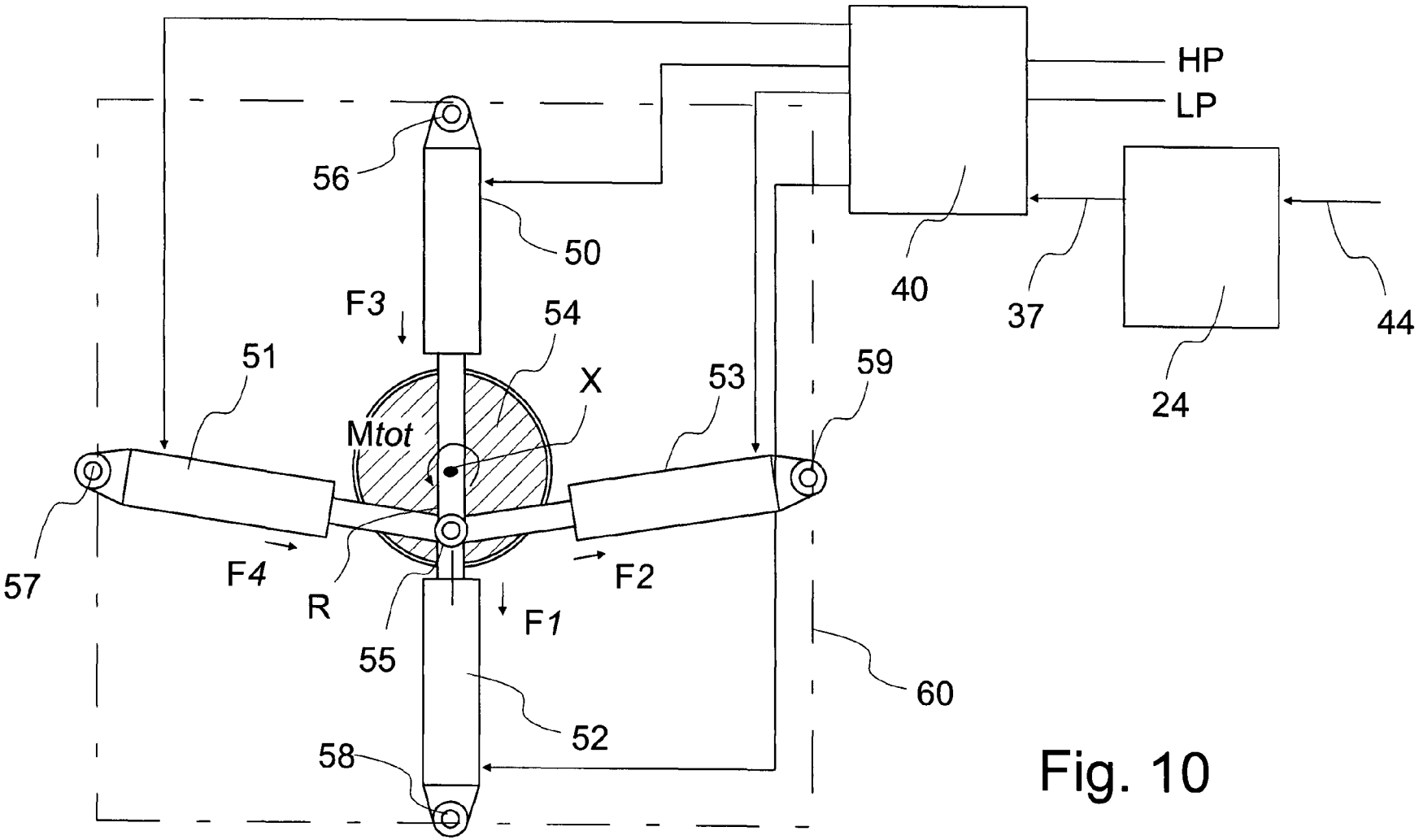
FIG. 10 shows an eccentric pump motor according to an example of the invention.

In the example of FIG. 10, a digital hydraulic pump motor 49 comprises, for example, four actuators 50, 51, 52, and 53, which are cylinders and rotate a turning member 54 having a rotation axis X and to which the actuators are connected at a distance from the rotation axis, wherein the combined actuators are capable of generating a total moment $M_{tot}$ effective on the turning member 54 (or wobbler 54) and drive the load. Preferably, all the actuators have a common connecting point 55. The device 49 is mounted, for example in slewing motor use, on the frame of a movable working machine, and it is used for rotating the cabin or crane of a working machine. In a corresponding manner, in pump use, the turning member is connected, for example, to the drive shaft. Typically, the device is applied in pump, motor or pump motor rotation drives, in which the turning member (54) converts a linear movement to a rotating movement.

The pump motor drive with a continuously rotating path is obtained, in the simplest way, by coupling two force-controlled actuators to the turning member 54 in an eccentric manner by using a 90° phase shift. Particularly, the actuator described above and shown in FIG. 1 is used as the actuator. However, because the actuator is asymmetric with respect to its maximum forces, that is, the maximum force is stronger in the positive (propulsive) direction than in the negative (tractive) direction, the maximum total moment $M_{tot}$ would become relatively asymmetric, that is, the maximum moment achieved in one direction of rotation would be different from that in the other direction of rotation. For this reason, it is justifiable to connect at least three cylinder actuators in an eccentric manner with a phase shift of 120° to the turning member 54, to make the maximum total moment more symmetrical. Furthermore, a more symmetrical maximum of the moment in both directions is produced by coupling four cylinders with a phase shift of 90° to the turning member 54, as shown in FIG. 10.

In the digital pump motor 49 and the system controlling the same, including the controller, the energy-saving optimization of the initial tensions can be implemented by applying the same principles as in the slewing device discussed above with reference to FIG. 9.

The connecting points of the actuators refer to the articulated connecting points 56, 57, 58, and 59 (J1, J2, J3, and J4, respectively), via which the actuators are connected to the frame 60 of the device. As shown in the figure, each actuator is connected 30 between a common eccentric articulated effective point P (connecting point 55) and the above-mentioned articulated connecting points placed regularly with respect to the slewing circle. The distances between the connecting points and the centre of rotation O (rotation axis X) are equal to each other, as well as the phase shift angles seen across the slewing circle. In the example case, four cylinder actuators are used with phase shift angles of 90°.

The radius vector of the wobbler refers to a vector R drawn from the centre of rotation O of the wobbler to the common eccentric connecting point P of the actuators. Effective lever vectors $r_1$, $r_2$, $r_3$ and $r_4$ (vector $r_n$) of the actuators refer to the shortest vector drawn from the centre of rotation 5 of the wobbler to the straight line of the effective force of the actuator, which vector is thus at a right angle to the straight line of the effective force generated by the actuator. In FIG. 10, the actuators 50 and 52 are in their lower and upper ends of stroke, so that their effective lever vectors are zero vectors.

The length of the effective lever vector of the actuator is agreed to be positive when the propulsive or positive force generated by the actuator generates a positive moment (counterclockwise) to the wobbler. Thus, the connecting point P is in the right half of the circle of rotation, seen from the connecting point of the actuator. In a corresponding manner, the length of the effective lever vector is agreed to be negative, when the positive (propulsive) force generated by the actuator corresponding to it generates a negative moment to the wobbler (clockwise). Thus, the connecting point P is in the left half of the circle of rotation, seen from the connecting point of the actuator. In this document, the effective lever of the actuator refers to the length of the effective lever vector. The actuators 50, 51, 52, and 53 generate the single force vectors $F_1$, $F_2$, $F_3$, and $F_4$, respectively. The direction of the force vectors is parallel to a line segment drawn from the connecting point of each actuator the effective point P of the wobbler, however, in such a way that the direction of the effective force may be either propulsive or tractive, that is, positive or negative. The force resultant vector $F_{tot}$ refers to the sum vector of the force vectors generated by the single actuators.

The relative effective lever of the actuator refers to the ratio between the length of the effective lever vector and the maximum value of the length of the effective lever vector. Thus, for the relative effective lever of each actuator, the following applies:

$$r_{rel_n} = \frac{|\bar{r}_n|}{|\bar{r}_{max_n}|}$$

The numerical value of the variable becomes zero each time when the actuator is at its dead centres and receives the value +1 or −1 when the lever is in its maximum length in the positive or negative direction. The maximum lengths of the lever occur at points where the straight line of action of the force of the actuator hits the tangent of the circle of rotation of the effective point P of the wobbler.

We shall next discuss the control system of the digital pump motor and its principle of operation.

The relative control each single actuator of the device is generated by multiplying the relative control of the moment of the slewing drive by the length of the relative effective lever of said actuator. In the example case, the aim is to produce a positive moment; in other words, the direction of the moment is counterclockwise. When the two actuators 50 and 52 placed opposite each other are at their dead centres, the other two actuators 51 and 53 are placed symmetrically as mirror images of each other with respect to the radius vector R of the wobbler. Thus, the effective levers $r_1$ and $r_3$ of the actuators 50 and 52 are also reflected with respect to the radius vector R; that is, they are equal in length but have opposite signs, wherein the force vectors $F_1$ and $F_3$ are scaled equally long with respect to each other and are placed symmetrically with respect to a vertical line segment drawn through the point P. Thus, the resultant force vector $F_{tot}$ becomes vertical, that is, is placed at a right angle to the radius vector R of the wobbler. At the dead centres of the actuators 51 and 53, the force vectors of said actuators are zero vectors, because their effective levers $r_2$ and $r_4$ are zero vectors, according to which the force vectors are scaled.

Half-way between the dead centres, the actuators 50 and 53 are placed symmetrically to each other with respect to the radius vector R, as well as the actuators 51 and 52. Thus, the effective levers $r_2$ ja $r_3$ are also reflected with respect to the radius vector R, as well as the lever vectors $r_1$ and $r_4$. Thus, the sum vector of the forces $F_2$ ja $F_3$ is placed in parallel with the tangent of the circle of rotation of the effective point P of the wobbler 35, as well as the sum vector of the forces $F_1$ and $F_4$. Thus, the total resultant vector is also parallel to the tangent of the circle of rotation of the point P, that is, at a right angle to the radius vector of the wobbler.

The force resultant vector $F_{tot}$ is found to be at a right angle to the radius vector R of the wobbler with other rotation values as well. From this, it can be concluded that in this scaling method, the resultant force vector $F_{tot}$ is always at an almost right angle to the radius vector R, as far as the actuators operate in their linear ranges.

The digital hydraulic pump motor can be used in a digital hydraulic system as well as, with limitations, in a conventional hydraulic system, as a moment or force controlled motor drive which also returns the kinetic energy bound to the mechanism back to the hydraulic system, if necessary.

The digital hydraulic pump motor can also be used as a pQ controlled hydraulic pump (p=pressure, Q=volume flow), if necessary. Thus, the moment generated by the cylinders is set in the opposite direction as the moment directed on the mechanism from the outside. The utilization of the effective areas of the cylinders makes it possible to control the pressure, the volume flow, the driving moment and the output control. In the pump use, the volume flow and maximum pressure generated by the device are proportional to the effective surface and thereby also the driving moment. In this way, it is possible to optimize, for example, the operating range of the combustion engine driving the pump, to achieve the best possible efficiency.

If the pump motor is used as a hydraulic pump in the digital hydraulic system, this may require that the pump motor is also connected to a tank via separate control interfaces. FIGS. 13*a* and 13*b* illustrate the connection of a digital pump motor to a system of, for example, FIG. 11. The connection is made to charging circuits or subcircuits.

The energy-saving optimization of the initial tensions can be implemented in the same way as in the slewing device presented above. When controlling the digital pump motor, the combination of controls of the actuators to produce a zero moment can be selected any control values with which the sum of moments calculated for each actuator is zero. In this way, such a range of control of each actuator, at which the actuator performs the largest number of state changes, can be selected in the desired manner. The control of four actuators in the digital pump motor can be implemented, among other things, by converting the relative control of the moment directly to the control of the actuators, but in such a way that the sign of the control is changed at the upper and lower ends of stroke of the actuator. In this way, care is taken that the positive relative control of the moment will generate force production to a single actuator, producing a positive moment in the mechanism. The four actuators can also be controlled in such a way that the relative control of the moment is scaled to the control of the actuator, in proportion to the effective relative lever of the actuator. Furthermore, the variable used for scaling the control of a single actuator can also be another variable calculated on the basis of the rotation, by means of which variable the aim is to keep the sum vector of the forces produced by the cylinders at a right angle to the radius vector of the wobbler.

Digital Hydraulic Pressure Converter and Pump Pressure Converter

FIG. 11 shows a digital hydraulic pressure converter 112. A simple implementation of the pressure converter is shown in FIG. 15, in which the pressure converter comprises two double-acting and double-chamber cylinder actuators connected to each other opposite each other, wherein the piston rods are interlinked. The combined piston rods make up the moving part. Preferably, the outer mantles of the cylinder actuators are also interlinked. The ratios of the effective areas of the working chambers are selected as follows: A1:B1:A2:B2=2:1:2:1. The pressure converter of FIG. 16 comprises two double-acting and four-chamber cylinder actuators, in which the ratios of the effective areas of the working chambers are selected as follows: A1:B1:C1:D1=A2:B2:C2:D2=8:4:2:1. According to the example of FIG. 14, the cylinder actuators may also be different, wherein the ratios of the effective areas of the working chambers may also be selected as follows: A1:B1:A2:B2=8:4:2:1. Each cylinder actuator of the pressure converter may consist of a single- or multi-chamber unit, whose moving parts are mechanically interlinked either in parallel or in a nested way so that the desired effective areas and their mutual ratios are realized. Preferably, the generated force steps are equal in size.

The pressure converter operates in such a way that the first actuator is used to select a suitable sum force to be generated within the range of the pressures of the charging circuits coupled to the actuator, by which sum force it is possible to perform the necessary energy transfer between the charging circuits coupled to the second actuator, and with low energy losses: The first actuator exerts said sum force to the moving part of said actuator, and the second actuator generates a force in the opposite direction but with a slightly different magnitude to the moving part of said actuator, which enables the movement of the piston. When the moving part of the actuator approaches the end of the actuator, the couplings of the charging circuits are exchanged with each other so that the direction of movement is changed but the conversion ratios between the charging circuits are maintained. In the example of FIG. 16, the charging circuit HP1 is coupled in place of the charging circuit HP1*a*, and the charging circuit LP1 is coupled in place of the charging circuit LP1*a*. The exchange is carried out by means of a separate control interface and its control valve or valves. In FIG. 15, the reference P1 corresponds to the HP1 circuit, the reference P2 corresponds to the HP2 circuit, and the reference P1*a* corresponds to the HP1*a* circuit, the reference P2*a* corresponds to the HP2*a* circuit.

We shall next discuss an example of a control situation, in which the pressure converter is used to perform a conversion that quintuples the pressure. It is assumed that the pressure converter applies two presented cylinder actuators coupled opposite each other and having four cylinders. It is assumed that the pressure of the LP1 circuit coupled to the first actuator is about 0 MPa and the pressure of the HP1 circuit is about 10 MPa. It is assumed that the pressure of the LP1*a* circuit coupled to the second actuator is about 0 MPa and the pressure of the HP1*a* circuit is slightly below 50 MPa. It is now possible to transfer energy from the charging circuits under lower pressures to the HP1*a* circuit, as follows: a piston movement to extend the first actuator is generated by coupling the control of the first actuator to be u %=15 and the control of the second actuator to be u %=7, wherein the ratio between the effective areas of the working chambers coupled to the two highest pressures becomes 5:1. In a corresponding manner, an opposite piston movement is generated by coupling the control of the first actuator to be u %=0 and the control of the second actuator to be u %=4, wherein the ratio between said areas becomes −5/−1 (=5/1). In a corresponding manner, the pressure conversion can be performed in both directions of movement with also other conversion ratios achieved by said actuator, which fall within the range from 1:5 to 5:1.

Higher conversion ratios are only achieved in a discontinuous manner, that is, solely when moving in one of the two directions. The maximal conversion ratio achieved in both directions of movement is determined by the ratio between the sum of the effective areas making the actuator shorter and the smallest effective area making the actuator shorter, which is, in this case, (4+1)/1=5/1.

The force production ranges of said actuators must be at least partly the same, so that the sum force effective on the moving part can be maintained sufficiently small, whereby also throttling of the pressurized medium is avoided and energy is not consumed unnecessarily.

If the starting point is that certain charging circuits, for example HP1 and LP1, are always coupled solely to the first actuator of the pressure converter, and certain other charging circuits, for example HP1*a* and LP1*a*, are always coupled solely to the second actuator of the pressure converter, it is possible to perform an energy efficient conversion solely in such a force production range common to said actuators, in which the forces of the actuators are capable of approximately compensating for each other.

Figure 18:
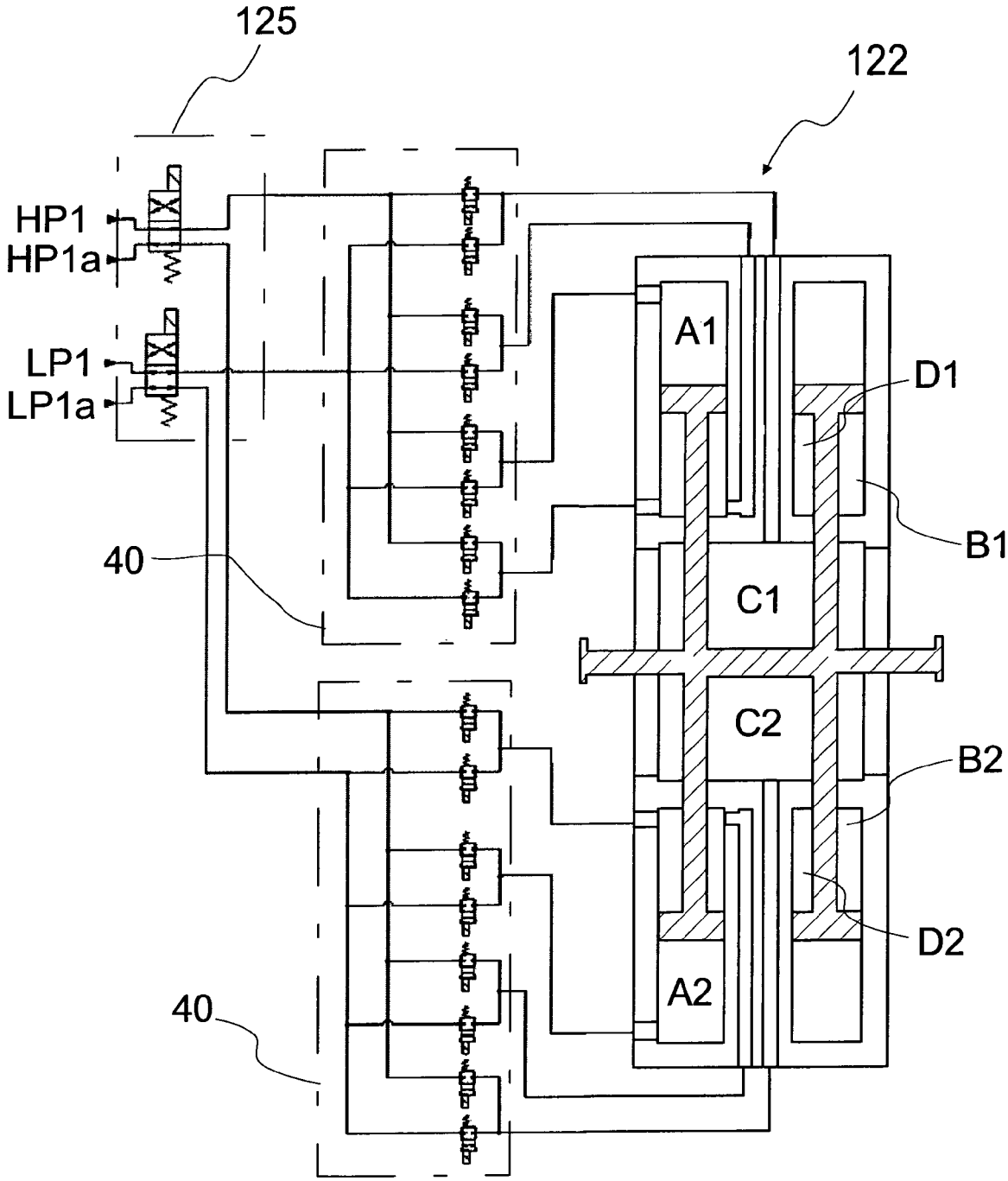
FIG. 18 shows a pump pressure converter according to an example, comprising eight chambers and being controlled by a control circuit.

If it is desired to make the pressure converter utilize a larger range of conversion symmetrically in both directions of movement, this can be realized with a coupling allowing that only forces which extend the actuator are used in the pressure conversion. This kind of a coupling is used to exchange the charging circuits led to the actuators for each other. In the examples of FIGS. 17 and 18, this means that the charging circuit HP1 is coupled in place of the charging circuit HP1*a*, and the charging circuit LP1 is coupled in place of the charging circuit LP1*a*. In a corresponding manner, the charging circuit HP1*a* is coupled in place of the charging circuit HP1, and the charging circuit LP1*a* is coupled in place of the charging circuit LP1. The exchange takes place by means of a separate control valve or valve system, for example a two-positioned four-way directional valve, according to the control circuit 125 of FIG. 18, or alternatively by means of a cross connection with on/off valves, according to the control circuit 126 of FIG. 17. With the exchange, the conversion ratio of the pressure converter is maintained, irrespective of the direction of movement of the moving part. Thus, the force production ranges of the actuators do not need to cut each other to perform an energy efficient pressure conversion.

Furthermore, more conversion ratios of the pressure converter and coupling combinations of the charging circuits are obtained with a coupling, in which a coupling possibility, that is, a separate control interface, is provided between each chamber and each charging circuit. By means of such a control circuit, any pressurized medium circuit comprised in the system can be coupled to any working chamber of any actuator, wherein the energy can be transferred by utilizing a single conversion ratio (1:1) from one pressure circuit to another pressure circuit and, by utilizing several different alternative conversion ratios, from two or more pressure circuits to one or more other pressure circuits, or from one or more pressure circuits to two or more other pressure circuits, or from two or more pressure circuits to two or more other pressure circuits.

By coupling the pressure converter to an external source of energy, it is possible to transfer external mechanical energy to the charging circuits in the form of hydraulic energy. For example, kinetic energy is effective on the moving part directly or via a part connected to it and generates a preferably reciprocating pumping motion which, by means of the piston of the cylinder actuator, generates the pressure of the pressurized medium in the working chamber. The hydraulic energy can be further stored in an energy charging unit or utilized in other ways or in other actuators.

The invention is not limited solely to the above-presented examples, but it can be applied within the scope of the appended claims.

The invention claimed is:

1. A pressurized medium system, comprising:

at least one actuator or actuator unit configured to generate sum forces effective on a load;

at least two working chambers operating by the principle of displacement and located in said actuator or actuator unit, the at least two working chambers including at least two predetermined working chambers;

at least one charging circuit of a higher pressure, which is a source of hydraulic power capable of both producing and receiving a volume flow at a first predetermined pressure level;

at least one charging circuit of a lower pressure, which is a source of hydraulic power capable of both producing and receiving a volume flow at a second predetermined pressure level; and a control circuit configured to couple at least one of said charging circuits of higher pressure and at least one of said charging circuits of lower pressure in turn to each predetermined working chamber, wherein the control circuit comprises, for each predetermined working chamber, a first controllable control interface configured to open and close a first connection to said charging circuit of higher pressure, and a second controllable control interface, separate from the first controllable control interface, configured to open and close a second connection to said charging circuit of lower pressure, the first controllable control interface and the second controllable control interface each comprise an on/off controlled shut-off valve or several on/off controlled shut-off valves connected in parallel, each predetermined working chamber is capable of generating force components that correspond to the first predetermined pressure level and the second predetermined pressure level of the at least one charging circuit of higher pressure and the at least one charging circuit of lower pressure, respectively, to be coupled to each respective predetermined working chamber, and at least one of the sum forces is produced by the force components generated by the at least two predetermined working chambers.

2. The system according to claim 1, wherein at least two of said charging circuits is capable of receiving a volume flow from the predetermined working chamber, to which the charging circuit is coupled to generate a force component.

3. The system according to claim 1, wherein said actuator or actuator unit is configured to control the load by means of said sum forces, which are variable, wherein for said control and at each moment of time, one of said force components is selected for use by each predetermined working chamber.

4. The system according to claim 1, wherein the control circuit comprises a series of control interfaces which are configured to supply hydraulic power of the charging circuits to the predetermined working chambers substantially without loss.

5. The system according to claim 1, wherein said control circuit is configured to couple a first one of the charging circuits to one of said predetermined working chambers, for the supply of hydraulic power, and simultaneously to couple a second one of said charging circuits to another one of said predetermined working chambers, for returning a volume flow simultaneously to said second charging circuit.

6. The system according to claim 1, wherein said actuator or actuator unit is configured as an energy charging unit, in which the hydraulic power of any one of said charging circuits can be converted to potential energy to be stored, and from which, if necessary, said stored potential energy can be converted back to hydraulic power into any one of said charging circuits.

7. The system according to claim 1, wherein each of said charging circuits comprises a pressure accumulator.

8. The system according to claim 1, wherein the system also comprises:

at least one pump unit that utilizes pressurized medium and produces hydraulic power; and a control and safety valve system configured to couple said pump unit to said charging circuits, one or more at the same time, either for supplying hydraulic power to one or more charging circuits, or for receiving pressurized medium from one or more charging circuits, or for performing both of these operations at the same time.

9. The system according to claim 8, wherein:

said pump unit comprises a suction line and a pressure line; and said control and safety valve system is configured to couple the pressure line to one of the charging circuits to raise a pressure level of the coupled charging circuit coupled to the pressure line and to maintain the pressure level at a predetermined pressure level; and said control and safety valve system is further configured to couple the suction line to one of the charging circuits to lower a pressure level of the charging circuit coupled to the suction line and to maintain the pressure level at a predetermined pressure level.

10. The system according to claim 1, wherein the ratios of effective areas of said predetermined working chambers follow the series NM, in which N is the number of said charging circuits, M is the number of said predetermined working chambers, and both N and M are integers.

11. The system according to claim 1, wherein the pressure level of at least one charging circuit of higher pressure and at least one charging circuit of lower pressure is adjustable, wherein the relative differences between said generated sum forces are also adjustable, wherein the pressure levels of said charging circuits are configured to correspond to the sum forces needed for control of the load in an optimized way.

12. The system according to claim 1, wherein said actuator or actuator unit is, for control of the load, configured to accelerate said load by one or more of the sum forces and to decelerate said load by one or more of the sum forces.

13. The system according to claim 12, wherein during deceleration of the load, at least one of said predetermined working chambers is configured to convert kinetic energy of the load to hydraulic power and to supply the hydraulic power to one of said charging circuits.

14. The system according to claim 1, wherein said actuator or actuator unit is configured as part of a pressure converter, by means of which hydraulic power of a charging circuit can be converted to hydraulic power of another charging circuit.

15. The system according to claim 1, further comprising:

a pressure converter by means of which hydraulic power can be transferred from at least one of said charging circuits to at least one other one of said charging circuits;

at least one sub-charging circuit of higher pressure;

at least one sub-charging circuit of lower pressure, which is a source of hydraulic power;

at least one auxiliary actuator or auxiliary actuator unit that constitutes the load;

at least one auxiliary working chamber operating on the principle of displacement and located in said auxiliary actuator or auxiliary actuator unit; and a second control circuit, by means of which said sub-charging circuits can be coupled in turns to each auxiliary working chamber, wherein each auxiliary working chamber is capable of generating pressure and volume flow to the coupled sub-charging circuit, and wherein said actuator or actuator unit is configured to move said auxiliary actuator or auxiliary actuator unit for transferring hydraulic power.

16. The system according to claim 15, wherein said actuator comprises a first moving part and the auxiliary actuator comprises a second moving part, wherein said first moving part and said second moving part are interlinked to transfer a movement between said actuator and said auxiliary actuator.

17. The system according to claim 16, wherein the system further comprises at least one charging circuit of an intermediate pressure, which is the source of hydraulic power capable of both producing and receiving a volume flow at a third predetermined pressure level and whose pressure level is between said higher pressure and said lower pressure; wherein, to minimize energy losses, a controller is configured to couple a sorking chamber to the charging circuit of the medium without throttling; and wherein the coupling to said medium pressure takes place before the pressure of the working chamber is switched to the higher pressure, when there is a lower pressure in the working chamber, and before the pressure of the working chamber is switched to the lower pressure, when there is a higher pressure in the working chamber, wherein the energy needed for a state change is first bound from the working chamber or charging circuit via a parasitic inductance of pipework to kinetic energy of the charging circuit and thereby further to pressure energy of the working chamber, before performing the final coupling of the working chamber to the charging circuit of the higher pressure or the lower pressure.

18. The system according to claim 15, wherein at least three of said charging circuits, whose predetermined pressure levels differ from each other, can be coupled in turns to each predetermined working chamber and each auxiliary working chamber.

19. The system according to claim 15, further comprising:

a third control circuit, by means of which at least one of said charging circuits of higher pressure can be coupled to the auxiliary actuator instead of the actuator and simultaneously at least one of the sub-charging circuits of lower pressure can be coupled to said actuator instead of the auxiliary actuator, and by means of which at least one of said charging circuits of lower pressure can be coupled to the auxiliary actuator instead of the actuator and simultaneously at least one of said sub-charging circuits of higher pressure can be coupled to said actuator instead of the auxiliary actuator, wherein a reciprocating motion can be generated in the pressure converter, by means of which motion pressure and volume flow can be generated without interruption.

20. The system according to claim 15, wherein the moving parts of the actuator and the auxiliary actuator are coupled to an external source of kinetic energy that moves said first moving part and said second moving part and generates hydraulic power to said predetermined working chambers and the charging circuit coupled thereto.

21. The system according to claim 15, wherein the apparatus comprises a third control circuit, by means of which any one of said charging circuits can be coupled to any one of the predetermined working chambers, wherein energy can be transferred from two or more of said charging circuits to one or more other ones of said charging circuits, or from one or more of said charging circuits to two or more other ones of said charging circuits, or from two or more of said charging circuits to two or more other ones of said charging circuits, by utilizing several alternative conversion ratios.

22. The system according to claim 1, wherein the system also comprises:

at least one controller for control of the sum force generated by an actuator or actuator unit, arranged to control said control circuit and having, as its input, a guideline value for the sum force to be generated, acceleration of the load, speed of the load, or position of the load;

wherein said controller is further configured to control, at each moment of time, couplings made by said control circuit in such a way that the generated force components produce a sum force corresponding to or closely related to said guideline value.

23. The system according to claim 22, wherein states of said control circuit are stored in said controller, each of the states representing the couplings of said control circuit to generate one sum force, wherein said controller is configured to set the states of the control circuit in such an order that proportionally corresponds to an order of magnitude of the sum forces to be generated; and wherein an output of said controller is control values to be given to said control circuit for setting said control circuit in such a state that corresponds to said guideline value in each loading situation.

24. The system according to claim 23, wherein such states of the control circuit are not selected for use in said controller, by which effect of a faulty control interface on the sum force to be generated is significant.

25. The system according to claim 24, wherein the controller is arranged to monitor the state of said control interface and to check if the state of the control interface corresponds to the state according to the control value, and to conclude if there is a fault situation of said control interface.

26. The system according to claim 23, wherein as a result of a failure in control surface, said controller is configured to set the states of the control circuit in such a new order that proportionally corresponds to an order of magnitude of the sum forces to be generated in a situation, in which the faulty control interface is still in use.

27. The system according to claim 22, wherein the states of said working chambers are stored in said controller, each of the states representing the couplings of the predetermined working chambers to generate one sum force, and the control values corresponding to them, scaled in an order that corresponds proportionally to an order of magnitude of the sum forces to be generated.

28. The system according to claim 1, wherein said actuator is an actuator of a slewing device for controlling pivoting movement of the load coupled to said slewing device, wherein there are at least two actuators and the at least two actuators generate a variable total moment effective on the load, and the slewing device further comprises members for converting linear movements generated by said actuators to a pivoting movement of the load.

29. The system according to claim 1, wherein said actuator is an actuator of a pump motor and is force-controlled or force-adjusted by a method of control without throttling, whereby a load moment with a direction opposite to a direction of rotation is generated on a drive shaft coupled to an external energy source, such as a drive motor, wherein said actuator acts as a pump in combination with other actuators coupled to a same wobbler.

30. The system according to claim 1, wherein said actuator is an actuator of a rotating device, for controlling movement of rotating a load coupled to said rotating device, wherein the system includes at least two actuators, and the rotating device further comprises members for converting linear movements generated by said actuators to a movement of rotating the load.

31. A slewing device for controlling the pivoting movement of a load, comprising:

at least two actuators or actuator units configured to generate sum forces effective on the load for the control of the pivoting movement of the load, at least two working chambers operating on a principle of displacement, located in said actuators or actuator units, the at least two working chambers including at least two predetermined working chambers, members for converting the movements generated by said actuators or actuator units to a pivoting movement of the load and for converting the sum forces generated to a total moment effective on the load;

at least one charging circuit of a higher pressure, which is a source of hydraulic power capable of both producing and receiving a volume flow at a first predetermined pressure level;

at least one charging circuit of a lower pressure, which is a source of hydraulic power capable of both producing and receiving a volume flow at a second predetermined pressure level; and a control circuit configured to couple at least one of said charging circuits of higher pressure and at least one of said charging circuits of lower pressure in turn to each predetermined working chamber, wherein the control circuit comprises, for each predetermined working chamber, a first controllable control interface configured to open and close a first connection to said charging circuit of higher pressure, and a second controllable control interface, separate from the first controllable control interface, configured to open and close a second connection to said charging circuit of lower pressure, the first controllable control interface and the second controllable control interface each comprise an on/off controlled shut-off valve or several on/off controlled shut-off valves connected in parallel, each predetermined working chamber is capable of generating force components that correspond to the first predetermined pressure level and the second predetermined pressure level of the at least one charging circuit of higher pressure and the at least one charging circuit of lower pressure, respectively, to be coupled to each respective predetermined working chamber, and at least one of the sum forces is produced by the force components generated by the at least two predetermined working chambers.

32. The slewing device according to claim 31, wherein the at least two predetermined working chambers comprise at least four predetermined working chambers, wherein the ratios of the effective areas of said at least four predetermined working chambers follow the series NM, in which N is the number of said charging circuits, M is the number of said predetermined working chambers, and both N and M are integers.

33. The slewing device according to claim 31, wherein said actuators or actuator units are parallel cylinder actuators in the same position, generating sum forces in opposite directions, wherein the slewing device comprises a slewing gear wheel, by means of which said sum forces can be converted to corresponding total moments, and wherein said actuators or actuator units are located on opposite sides of said slewing gear wheel.

34. The slewing device according to claim 31, wherein the slewing device further comprises at least one controller provided for force control of the slewing device, the controller being configured to control said control circuit and having, as its input, a guideline value for the sum force to be generated; wherein said controller is further configured to control, at each moment of time, couplings made by said control circuit in such a way that the generated force components produce a sum force corresponding to or closely related to said guideline value.

35. A rotating device for controlling the rotation of a load, comprising:

at least two actuators or actuator units configured to generate total moments effective on the load for the control of the pivoting movement of the load, at least two working chambers operating on a principle of displacement, located in said actuators or actuator units, the at least two working chambers including at least two predetermined working chambers, members for converting the movements generated by said actuators or actuator units to a movement of rotating the load;

at least one charging circuit of a higher pressure, which is a source of hydraulic power capable of both producing and receiving a volume flow at a first predetermined pressure level;

at least one charging circuit of a lower pressure, which is a source of hydraulic power capable of both producing and receiving a volume flow at a second predetermined pressure level; and a control circuit configured to couple at least one of said charging circuits of higher pressure and at least one of said charging circuits of lower pressure in turn to each predetermined working chamber, wherein the control circuit comprises, for each predetermined working chamber, a first controllable control interface configured to open and close a first connection to said charging circuit of higher pressure, and a second controllable control interface, separate from the first controllable control interface, configured to open and close a second connection to said charging circuit of lower pressure, the first controllable control interface and the second controllable control interface each comprise an on/off controlled shut-off valve or several on/off controlled shut-off valves connected in parallel, each predetermined working chamber is capable of generating force components that correspond to the first predetermined pressure level and the second predetermined pressure level of the at least one charging circuit of higher pressure and the at least one charging circuit of lower pressure, respectively, to be coupled to each respective predetermined working chamber, and at least one of the total moments is produced by the force components generated by the at least two predetermined working chambers.

36. The rotating device according to claim 35, wherein the rotating device comprises at least four said actuators or actuator units and at least four said predetermined working chambers.

37. The rotating device according to claim 35, wherein ratios of the effective areas of said predetermined working chambers follow the series NM, in which N is the number of said charging circuits, M is the number of said predetermined working chambers, and both N and M are integers.

38. The rotating device according to claim 35, wherein the rotating device further comprises at least one controller provided for force control of the rotating device, the controller being configured to control said control circuit and having, as its input, a guideline value for the total moment to be generated; wherein said controller is further configured to control, at each moment of time, couplings made by said control circuit in such a way that the generated force components produce a total moment corresponding to or closely related to said guideline value.

39. The rotating device according to claim 35, wherein at least one of said predetermined working chambers is configured, during pivoting movement of the load, to generate hydraulic power and to supply it to one of said charging circuits.

40. A method in a pressurized medium system, the system comprising:

at least one actuator or actuator unit configured to generate sum forces effective on a load;

at least two working chambers operating by a principle of displacement and located in said actuator or actuator units, the at least two working chambers including at least two predetermined working chambers;

at least one charging circuit of a higher pressure, which is a source of hydraulic power capable of both producing and receiving a volume flow at a predetermined pressure level;

at least one charging circuit of a lower pressure, which is a source of hydraulic power capable of both producing and receiving a volume flow at a predetermined pressure level; and a control circuit, by means of which at least one said charging circuits of higher pressure and at least one of said charging circuits of lower pressure can be coupled, in turn, to each predetermined working chamber, wherein the control circuit comprises, for each predetermined working chamber, a first controllable control interface configured to open and close a first connection to said charging circuit of higher pressure, and a second controllable control interface, separate from the first controllable control interface, configured to open and close a second connection to said charging circuit of lower pressure, the first controllable control interface and the second controllable control interface each comprise an on/off control led shut-off valve or several on/off controlled shut-off valves connected in parallel, the method comprising:

generating, in each predetermined working chamber, force components that correspond to the first predetermined pressure level and the second predetermined pressure level of the at least one charging circuit of higher pressure and the at least one charging circuit of lower pressure, respectively, to be coupled to each respective predetermined working chamber; and producing, with each of said force components, at least one of said sum forces in combination with the force components generated by the other predetermined working chambers.

41. The method according to claim 40, wherein the system also comprises:

at least one controller for control of the sum force generated by said at least one actuator or actuator unit, the at least one controller being arranged to control said control circuit and having, as its input, a guideline value for the sum force to be generated, acceleration of the load, speed of the load, or position of the load;

the method further comprising:

using said controller to control, at each moment of time, couplings made by said control circuit in such a way that the generated force components produce a sum force corresponding to or closely related to said guideline value.

42. A controller for the control of a pressurized medium system, the pressurized medium system comprising:

at least one actuator or actuator unit configured to generate sum forces effective on a load;

at least two working chambers operating by a principle of displacement and located in said actuator or actuator units, the at least two working chambers including at least two predetermined working chambers;

at least one charging circuit of a higher pressure, which is a source of hydraulic power capable of both producing and receiving a volume flow at a first predetermined pressure level;

at least one charging circuit of a lower pressure, which is a source of hydraulic power capable of both producing and receiving a volume flow at a second predetermined pressure level; and a control circuit by means of which at least one said charging circuits of higher pressure and at least one of said charging circuits of lower pressure can be coupled, in turn, to each predetermined working chamber, wherein corresponding force components can be generated in each predetermined working chamber, wherein the control circuit comprises, for each predetermined working chamber, a first controllable control interface configured to open and close a first connection to said charging circuit of higher pressure, and a second controllable control interface, separate from the first controllable control interface, configured to open and close a second connection to said charging circuit of lower pressure, the first controllable control interface and the second controllable control interface each comprise an on/off controlled shut-off valve or several on/off controlled shut-off valves connected in parallel, wherein said controller is configured:

to control said control circuit based on an input that is a guideline value for the sum force to be generated, acceleration of the load, speed of the load, or position of the load; and to control, at each moment of time, couplings made by said control circuit in such a way that said predetermined working chambers produce a sum force corresponding to or closely related to said guideline value so that a combination of several generated force components produces said sum force.

43. The controller according to claim 42, wherein states of said control circuit are stored in said controller, each of the states representing the couplings of said control circuit to generate one sum force, wherein said controller is configured to set the states of the control circuit in such an order that proportionally corresponds to an order of magnitude of the sum forces to be generated; and wherein an output of said controller is control values to be given to said control circuit for setting said control circuit in such a state that corresponds to said control value in each loading situation.

44. The controller according to claim 42, wherein states of said predetermined working chambers are stored in said controller, each of the states representing the couplings of the predetermined working chambers of the actuator to generate one sum force, and control values corresponding to them, scaled in an order that proportionally corresponds to an order of magnitude of the sum forces to be generated.

* * * * *